US011459755B2

(12) United States Patent
Strickland

(10) Patent No.: US 11,459,755 B2
(45) Date of Patent: Oct. 4, 2022

(54) CONCRETE FILLABLE STEEL JOIST

(71) Applicant: Michael R. Strickland, Richmond Hill (CA)

(72) Inventor: Michael R. Strickland, Richmond Hill (CA)

(73) Assignee: INVENT TO BUILD INC., Richmond Hill (CA)

( * ) Notice: Subject to any disclaimer, the term of this patent is extended or adjusted under 35 U.S.C. 154(b) by 0 days.

(21) Appl. No.: 16/931,031

(22) Filed: Jul. 16, 2020

(65) Prior Publication Data

US 2021/0017765 A1 Jan. 21, 2021

(30) Foreign Application Priority Data

Jul. 16, 2019 (CA) ..... CA 3050000

(51) Int. Cl.
*E04C 3/294* (2006.01)
*E04C 3/293* (2006.01)
(Continued)

(52) U.S. Cl.
CPC ..... *E04C 3/294* (2013.01); *E04B 1/30* (2013.01); *E04B 5/04* (2013.01); *E04B 5/10* (2013.01);
(Continued)

(58) Field of Classification Search
CPC ..... E04B 1/30; E04B 1/2403; E04B 5/10; E04B 5/04; E04B 5/14; E04B 5/29;
(Continued)

(56) References Cited

U.S. PATENT DOCUMENTS 614,530 A * 11/1898 Brown ..... E04B 5/29 52/328
827,268 A 7/1906 Stieper
(Continued)

FOREIGN PATENT DOCUMENTS

AU 47479/79 12/1980
AU 59157/80 12/1981
(Continued)

OTHER PUBLICATIONS

International Search Report for PCT/CA2010/001750, dated Feb. 21, 2011.
(Continued)

*Primary Examiner* — Jessie T Fonseca
(74) *Attorney, Agent, or Firm* — Hill & Schumacher

(57) ABSTRACT

A concrete fillable steel joist includes a generally U-shaped member and a top chord. The generally U-shaped member has spaced apart webs and a bottom chord. The top chord is operably attached to the U-shaped member. The top chord has a plurality of spaced apart top chord holes. The U-shaped member and the top chord define a volume that is fillable with concrete when opposed ends of the U-shaped member have joist ends operably attached thereto. The joist ends may be a pair of end plates. Alternatively, the joist ends may be structural members. A concrete fillable steel joist system includes a plurality of spaced apart concrete fillable steel joists, and metal decking. The metal decking is operably attached between the spaced apart steel joists. The concrete fillable steel joist and the metal decking are configured to receive concrete.

29 Claims, 23 Drawing Sheets

(51) Int. Cl.

| | |
|---|---|
| ***E04B 1/30*** | (2006.01) |
| ***E04B 5/10*** | (2006.01) |
| ***E04B 5/04*** | (2006.01) |
| ***E04B 5/14*** | (2006.01) |
| ***E04B 5/40*** | (2006.01) |
| ***E04B 5/29*** | (2006.01) |
| *E04B 1/24* | (2006.01) |

(52) U.S. Cl.
CPC ..... *E04B 5/14* (2013.01); *E04B 5/29* (2013.01); *E04B 5/40* (2013.01); *E04C 3/293* (2013.01); *E04B 2001/2409* (2013.01); *E04B 2001/2415* (2013.01); *E04B 2001/2448* (2013.01); *E04B 2001/2478* (2013.01); *E04B 2103/02* (2013.01); *E04B 2103/06* (2013.01)

(58) Field of Classification Search
CPC ..... E04B 5/40; E04B 2001/2478; E04B 2103/02; E04B 2001/2415; E04B 2001/2454; E04B 2001/2448; E04B 2001/2409; E04B 2103/06; E04C 3/293; E04C 3/294; E04C 2003/0413; E04C 2003/0439; E04C 2003/0465
See application file for complete search history.

(56) References Cited

U.S. PATENT DOCUMENTS 947,514 A * 1/1910 Stevens ..... E04C 3/293 52/834
1,360,720 A 11/1920 Brown et al.
1,622,559 A 3/1927 Zabriskie
1,663,487 A 3/1928 Smith
1,735,590 A 11/1929 White
1,737,601 A 12/1929 Macomber
1,915,424 A 6/1933 Kerr
1,918,345 A 7/1933 McHose
1,941,211 A * 12/1933 Inglee ..... E04B 5/29 52/326
1,957,176 A * 5/1934 Kotrbaty ..... E04C 3/293 52/261
1,974,730 A 9/1934 Zollinger
1,983,632 A 12/1934 Miller
2,088,781 A 8/1937 Folsom
2,091,750 A * 8/1937 Coddington ..... E04C 2/28 52/601
2,108,373 A 2/1938 Greulich
2,169,253 A 8/1939 Kotrbaty
2,194,810 A 3/1940 Reiner
2,218,705 A * 10/1940 Faber ..... E04G 11/42 264/31
2,246,215 A 6/1941 Nagin et al.
2,256,812 A 9/1941 Miller
2,457,250 A 12/1948 Macomber
2,514,607 A 7/1950 McLean
2,624,430 A 1/1953 Macomber
2,630,890 A 3/1953 Macomber
2,662,272 A 12/1953 Macomber
2,731,824 A * 1/1956 Hadley ..... E04C 3/293 52/252
2,860,743 A 11/1958 Cliff
2,864,471 A 12/1958 Williams
3,063,122 A * 11/1962 Katz ..... E04G 13/04 249/50
3,110,049 A * 11/1963 Nagin ..... E01D 19/125 14/73
3,158,731 A 11/1964 Cape
3,221,467 A 12/1965 Henkels
3,288,977 A 11/1966 Keller
3,341,639 A * 9/1967 Naillon ..... E04B 5/29 264/35
3,349,535 A 10/1967 Balinski
3,367,080 A 2/1968 McClelland
3,381,439 A 5/1968 Thulin, Jr.
3,392,499 A 5/1968 McManus
3,483,665 A 12/1969 Miller
3,487,861 A 1/1970 Fahrenbach
3,503,173 A 3/1970 Jureit
3,527,007 A 9/1970 McManus
3,600,868 A 8/1971 Wilson
3,626,567 A 12/1971 Michelson et al.
3,639,962 A 2/1972 Gooder
3,641,303 A 2/1972 Collins
3,736,719 A 6/1973 Wise
3,818,083 A 6/1974 Butts et al.
3,942,297 A 3/1976 Kitagawa
3,945,168 A 3/1976 Butts et al.
3,945,741 A 3/1976 Wendt
3,979,868 A 9/1976 Butts et al.
4,017,051 A * 4/1977 Scott ..... E04G 13/04 249/50
4,041,664 A 8/1977 Davis, Jr.
4,056,908 A 11/1977 McManus
4,120,131 A * 10/1978 Carroll ..... E04B 1/164 52/310
4,122,647 A 10/1978 Kovar
4,151,694 A 5/1979 Sriberg et al.
4,159,604 A 7/1979 Burrell
4,189,883 A 2/1980 McManus
4,207,719 A 6/1980 Knowles
4,281,497 A 8/1981 Luotonen et al.
4,324,082 A 4/1982 Rutkowski et al.
4,385,476 A 5/1983 Slager
4,409,771 A 10/1983 Lowe
4,421,969 A 12/1983 Tanenbaum
4,432,178 A 2/1984 Taft
4,441,292 A 4/1984 Ericsson
4,454,695 A 6/1984 Person
4,476,662 A 10/1984 Fisher
4,490,958 A 1/1985 Lowe
4,548,014 A 10/1985 Knowles
4,549,381 A 10/1985 Holtz
4,560,301 A 12/1985 Gilb
4,566,240 A 1/1986 Schilger
4,569,177 A 2/1986 Ottinger
4,592,184 A 6/1986 Person et al.
4,593,506 A * 6/1986 Hartman ..... E04B 5/48 138/116
4,628,654 A * 12/1986 Boswel ..... E04B 5/40 52/319
4,653,237 A 3/1987 Taft
4,688,358 A 8/1987 Madray
4,691,494 A 9/1987 Gwynne
4,702,059 A 10/1987 Holtz
4,713,924 A * 12/1987 Toti ..... B21D 5/08 52/840
4,715,155 A 12/1987 Holtz
4,720,957 A 1/1988 Madray
4,729,201 A 3/1988 Laurus et al.
4,741,138 A 5/1988 Rongoe, Jr.
4,793,113 A 12/1988 Bodnar
4,836,436 A 6/1989 Hannah
4,837,994 A 6/1989 Stohs
4,845,908 A 7/1989 Stohs
4,887,406 A 12/1989 Saia
4,937,997 A 7/1990 Thomas, Jr. et al.
4,937,998 A 7/1990 Goldberg
4,947,612 A 8/1990 Taylor et al.
4,982,545 A 1/1991 Stromback
4,986,051 A 1/1991 Meyer et al.
5,004,369 A 4/1991 Young
5,050,358 A * 9/1991 Vladislavic ..... E04C 3/293 52/334
5,146,726 A 9/1992 Ellison, Jr.
5,207,045 A 5/1993 Bodnar
5,214,900 A 6/1993 Folkerts
5,220,761 A 6/1993 Selby
5,230,190 A 7/1993 Schuette
5,240,342 A 8/1993 Kress, Jr.
5,279,093 A 1/1994 Mead
5,301,486 A 4/1994 Taylor

(56) References Cited

U.S. PATENT DOCUMENTS 5,317,846 A * 6/1994 Michlovic ..... E04B 5/40 52/220.2
5,373,675 A 12/1994 Ellison, Jr.
5,417,028 A 5/1995 Meyer
5,476,704 A 12/1995 Kohler
5,499,480 A 3/1996 Bass
5,509,243 A 4/1996 Bettigole et al.
5,527,625 A 6/1996 Bodnar
5,544,464 A 8/1996 Dutil
5,546,716 A 8/1996 Broxterman et al.
5,553,437 A 9/1996 Navon
5,560,177 A 10/1996 Brightwell
5,625,995 A 5/1997 Martin
5,653,077 A * 8/1997 Carnicello ..... E04B 5/14 52/338
5,669,197 A 9/1997 Bodnar
5,687,538 A 11/1997 Frobosilo et al.
5,761,873 A 6/1998 Slater
5,771,653 A 6/1998 Dolati et al.
5,809,722 A * 9/1998 Bertsche ..... E04B 5/14 52/262
5,842,318 A 12/1998 Bass et al.
5,865,008 A 2/1999 Larson
5,875,605 A 3/1999 Rudd
5,881,520 A 3/1999 Blazevic
5,895,534 A 4/1999 Daley et al.
5,927,036 A 7/1999 Matthews et al.
5,937,608 A 8/1999 Kucirka
5,941,035 A 8/1999 Purse
6,073,414 A 6/2000 Garris et al.
6,131,362 A 10/2000 Buecker
6,167,675 B1 1/2001 LeBlanc
6,170,217 B1 1/2001 Meyer
6,176,053 B1 1/2001 St. Germain
6,240,682 B1 6/2001 James et al.
6,254,306 B1 7/2001 Williams
6,263,634 B1 7/2001 Bodnar et al.
6,301,854 B1 10/2001 Daudet et al.
6,301,857 B1 10/2001 Vrana
6,341,467 B1 * 1/2002 Wycech ..... B29C 44/18 296/193.06
6,357,191 B1 3/2002 Ault et al.
6,415,577 B1 7/2002 Curtis
6,418,694 B1 7/2002 Daudet et al.
6,436,552 B1 8/2002 Walker et al.
6,457,292 B1 10/2002 Vrana
6,484,464 B1 11/2002 Ochoa
6,519,908 B1 2/2003 Masterson et al.
6,571,527 B1 6/2003 Rattini
6,612,087 B2 9/2003 diGirolamo et al.
6,634,153 B1 10/2003 Peterson
6,658,809 B2 12/2003 Collins
6,662,517 B1 12/2003 Thompson
6,708,459 B2 * 3/2004 Bodnar
6,761,005 B1 7/2004 Daudet et al.
6,799,406 B2 10/2004 Gosselin et al.
6,799,407 B2 10/2004 Saldana
6,807,787 B1 10/2004 Ross
6,843,036 B2 1/2005 Stewart, III
6,874,294 B2 4/2005 Masterson et al.
6,964,140 B2 11/2005 Walker et al.
7,086,208 B2 8/2006 Masterson et al.
7,093,401 B2 8/2006 Collins
7,104,024 B1 9/2006 diGirolamo et al.
7,107,730 B2 9/2006 Park
7,127,862 B2 10/2006 Saldana
7,197,854 B2 4/2007 Bettigole
7,231,746 B2 6/2007 Bodnar
7,240,463 B2 7/2007 Masterson et al.
7,409,804 B2 8/2008 Moody et al.
7,451,575 B2 11/2008 Hall et al.
7,546,714 B2 6/2009 Masterson et al.
7,587,877 B2 9/2009 Strickland et al.
7,624,550 B2 12/2009 Ospina
7,765,771 B2 8/2010 Serpico et al.
7,877,961 B2 2/2011 Strickland et al.
8,281,540 B2 10/2012 Strickland et al.
8,407,966 B2 4/2013 Strickland et al.
8,555,592 B2 10/2013 Daudet et al.
8,943,776 B2 2/2015 Strickland et al.
8,950,151 B2 2/2015 Strickland et al.
9,909,308 B2 * 3/2018 Kwon ..... E04C 3/293
10,407,910 B2 * 9/2019 Janczura ..... E04C 3/293
10,597,864 B1 * 3/2020 Pearson ..... E04B 5/40
10,718,094 B1 * 7/2020 Nelson ..... E01D 2/04
2002/0005022 A1 1/2002 Matthews
2002/0020138 A1 2/2002 Walker et al.
2002/0026764 A1 * 3/2002 Sachs ..... E04C 3/34 52/834
2002/0029538 A1 3/2002 Webb
2002/0046534 A1 4/2002 Heinly
2002/0069606 A1 6/2002 Gosselin et al.
2002/0078645 A1 6/2002 Meyer
2002/0144484 A1 10/2002 Vrana
2003/0014934 A1 1/2003 Bodnar
2003/0014935 A1 1/2003 Bodnar
2003/0061780 A1 4/2003 Masterson
2003/0084637 A1 5/2003 Daudet
2004/0182027 A1 * 9/2004 Bonacci ..... E04C 3/293 52/319
2004/0226254 A1 * 11/2004 Charlwood ..... E04C 3/29 52/834
2005/0102962 A1 5/2005 McInerney et al.
2005/0108978 A1 * 5/2005 Strickland ..... B21D 47/01 52/633
2005/0115195 A1 6/2005 Bettigole et al.
2005/0144892 A1 7/2005 Strickland et al.
2006/0010809 A1 1/2006 Lafreniere
2006/0137115 A1 * 6/2006 Park ..... E04C 5/0645 14/74.5
2008/0282644 A1 * 11/2008 Hong ..... E04C 3/293 52/847
2009/0193750 A1 8/2009 Klima
2009/0205285 A1 8/2009 Jendusa
2009/0313937 A1 * 12/2009 Zureick ..... E04C 3/293 52/650.3
2009/0320395 A1 12/2009 Strickland et al.
2010/0139201 A1 6/2010 Strickland et al.
2010/0275544 A1 11/2010 Studebaker et al.
2011/0047915 A1 3/2011 Waters, Jr. et al.
2011/0120051 A1 5/2011 Strickland et al.
2011/0162319 A1 7/2011 Strickland et al.
2011/0219720 A1 9/2011 Strickland et al.
2012/0079782 A1 * 4/2012 Kim ..... E04B 5/29 52/220.1
2012/0137612 A1 * 6/2012 Buckholt ..... E04B 1/944 52/309.4
2012/0233956 A1 9/2012 Fey
2013/0232911 A1 * 9/2013 Stal ..... E04C 3/293 52/837
2013/0283721 A1 * 10/2013 Ahn ..... E04B 5/43 52/649.6
2019/0078314 A1 * 3/2019 Yin ..... E04C 3/20
2019/0093335 A1 * 3/2019 Nanayakkara ..... E04B 5/29
2019/0093359 A1 * 3/2019 Nanayakkara ..... E04C 3/293
2019/0093360 A1 * 3/2019 Nanayakkara ..... E04B 1/2403
2019/0376289 A1 * 12/2019 Hirayama ..... E04C 3/294

FOREIGN PATENT DOCUMENTS

AU 540590 1/1985
AU 543398 1/1985
AU 14733/97 2/1997
AU 199952660 10/1999
AU 199948840 A1 4/2000
AU 762835 7/2003
AU 2004100666 8/2004
CA 900687 5/1972
CA 1172463 8/1984
CA 2092809 11/2001
CA 2412726 11/2009
CA 2455071 11/2011
DE 2517485 A1 11/1975

(56) References Cited

FOREIGN PATENT DOCUMENTS

| | | | | | |
|---|---|---|---|---|---|
| DE | 29801562 | U1 | | 8/1999 | |
| FR | 1096922 | | | 6/1955 | |
| GB | 668485 | | | 3/1952 | |
| GB | 1447055 | | | 8/1976 | |
| GB | 2340141 | | | 2/2000 | |
| GB | 2340146 | A | | 2/2000 | |
| JP | 05263491 | A | * | 10/1993 | |
| JP | 06017483 | A | * | 1/1994 | |
| JP | 8338103 | | | 12/1996 | |
| JP | 2002061329 | A | * | 2/2002 | |
| KR | 20030037259 | A | * | 5/2003 | |
| WO | WO-9004690 | A1 | * | 5/1990 | ..... E04B 5/29 |
| WO | 99/38416 | A1 | | 8/1999 | |
| WO | 0046459 | | | 8/2000 | |
| WO | 02/01016 | | | 1/2002 | |
| WO | 03/057931 | | | 7/2003 | |
| WO | 2004038123 | | | 5/2004 | |
| WO | 2005/042869 | | | 5/2005 | |
| WO | 2010025569 | A1 | | 3/2010 | |
| WO | 2011029187 | A1 | | 3/2011 | |
| WO | 2011054094 | A1 | | 5/2011 | |
| WO | 2014047738 | A1 | | 4/2014 | |
| WO | WO-2014076502 | A1 | * | 5/2014 | ..... G09F 15/0068 |

OTHER PUBLICATIONS

Ortech Industries PTY LTD., "EASIBEAMS", Steel Sections [pamphlet], printed on Jun. 8, 2021.

International Search Report for PCT/CA2010/001405, dated Jan. 27, 2011.

International Search Report, PCT/CA2013/050738, filed Sep. 27, 2013, dated Jan. 24, 2014, 5 pages.

Seiki INSTAGRAM post by Risinger Build: Screenshot Jul. 1, 2020 at 1.54.17 PM.

* cited by examiner

CONCRETE FILLABLE STEEL JOIST

FIELD OF THE DISCLOSURE

This disclosure relates to steel joists and in particular steel joists that are fillable with concrete and a concrete fillable steel joist system.

BACKGROUND

For spanning multi residential structures, non-combustible concrete floors provide excellent fire ratings and a solid feeling for the occupants. Composite steel/concrete joist systems have been around since the 1970's, and they have proven to be an excellent means for providing cost effective floor systems for buildings.

Composite joists can be provided with open webs or utility holes for running mechanical/electrical equipment in the floor plenum. Joists are typically cambered and therefor do not need to be shored for the concrete pour. Joists require gypsum to be placed on the underside to provide 1 hour or greater fire ratings.

Another type of floor system that is good for the multi residential spans are composite deep metal decking filled with concrete. Composite metal deck systems typically do not need gypsum on the underside to achieve fire ratings. Unfortunately, deep deck systems need to be shored when the concrete is being poured. Deep decks do not have utility holes to allow passing mechanical/electrical systems through them.

Accordingly, it would be advantageous to provide a concrete fillable steel joist and a system using same.

SUMMARY

The present disclosure relates to steel joists that are fillable with concrete. A concrete fillable steel joist comprises: a generally U-shaped member having spaced apart webs and a bottom chord; a top chord operably attached to the U-shaped member, the top chord having a plurality of spaced apart top chord holes; and whereby the U-shaped member and the top chord define a volume that is fillable with concrete when opposed ends of the U-shaped member have joist ends operably attached thereto.

The concrete fillable steel joist may further include a pair of end plates operably attached at the opposed ends of the U-shaped member and wherein the pair of end plates are the joist ends.

The concrete fillable steel joist may include a pair of joist support struts attached to opposed ends of the top chord and extending outwardly from the U-shaped member.

The joist support struts may include a pair of joist shoes attached at a distal end thereof.

The concrete fillable steel joist may include a pair of joist diagonal members on either side of the U-shaped member, the joist diagonal members being operably attached to the U-shaped member and the joist support strut and wherein the pair of the joist diagonal members are operably attached at the opposed ends of the U-shaped member.

Each of the end plates of the pair of end plates may have a generally vertical portion and an angled portion and the angled portion is generally in registration with the pair of joist diagonal members.

Each of the joist support struts of the pair of joist support struts may have a plurality of spaced apart strut holes.

At least one joist end may be a structural member.

The joist ends may be structural members.

The concrete fillable steel joist may further include a joist moment connector assembly. The joist moment connector assembly may include a hook member operably attached to one of the U-shaped member and the structural member and rod member operably attached to the other of the U-shaped member and the structural member and the hook member engages the rod member.

The U-shaped member may include a plurality of punch outs proximate to the distal end thereof and the punch outs may be configured to be welded to joist moment connector assembly operably attached to the structural member.

The structural member may be a concrete fillable steel joist and one of the hook member and the rod member that is attached to the structural member is bolted through the concrete fillable steel joist.

The structural member may be a steel I-beam and one of the hook member and the rod member that is attached to the structural member is welded to the steel I-beam. The top chord may have two elongate channels formed therein for receiving the spaced apart webs of the U-shaped member.

The top chord may further include a pair of side tabs, wherein one side tab of the pair of side tabs extends outwardly from each of the elongate channels.

The side tabs may include a plurality of spaced apart tab holes.

The U-shaped member may include a plurality of utility holes and wherein each utility hole has a rim that is operably attached to the spaced apart webs around the utility hole.

The U-shaped member may further include a pair of bottom chord tabs extending outwardly from the bottom chord on either side of the spaced apart webs.

The concrete fillable steel joist may be cambered.

A concrete fillable steel joist system is also disclosed. The concrete fillable steel joist system comprises: a plurality of spaced apart concrete fillable steel joists as disclosed above; metal decking operably attached between the spaced apart concrete fillable steel joists; and whereby the concrete fillable steel joist and the metal decking is configured to receive concrete.

The concrete fillable steel joist system may include a plurality of spaced apart concrete fillable joists having a pair of end plates and a plurality of spaced apart concrete fillable joists attached thereto.

The metal decking may include a first deck portion and a second deck portion operably connected to each other.

The first deck portion and the second deck portion may have an overlapping joint.

The concrete fillable steel joist system further includes bridging members extending between and operably attached to the metal decking and the U-shaped members of the concrete fillable steel joists.

The metal decking may include a plurality of spaced apart elongate bottom flanges, a plurality of spaced apart elongate top flanges, a plurality of elongate webs extending outwardly and downwardly from the top flanges to the bottom flanges and a pair of elongate re-entrant lips extending outwardly from each side of and generally in the same plane as the top flanges.

The width of the top flange and the pair of elongate re-entrant lips may be less than the width of bottom flange.

The concrete fillable steel joist system may further include bridging members operably connected between adjacent spaced apart U-shaped members of the concrete fillable steel joists.

The concrete fillable steel joist system may include bridging members that extend between the bottom chords of the U-shaped members to the overlapping joint.

The top chord may include a pair of side tabs and a plurality of tab holes formed therein and the decking includes a plurality of decking tabs extendable downwardly therefrom and the tab holes are configured to receive the decking tabs.

Each decking tab may include a central portion and a pair of side wings and the side wings are bendable outwardly from the central portion.

A metal decking comprising a plurality of spaced apart elongate bottom flanges, a plurality of spaced apart elongate top flanges, a plurality of elongate webs extending outwardly and downwardly from the top flanges to the bottom flanges and a pair of elongate re-entrant lips extending outwardly from each side of and generally in the same plane as the top flanges.

The width of the top flange and the pair of re-entrant lips is less than the width of bottom flange.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
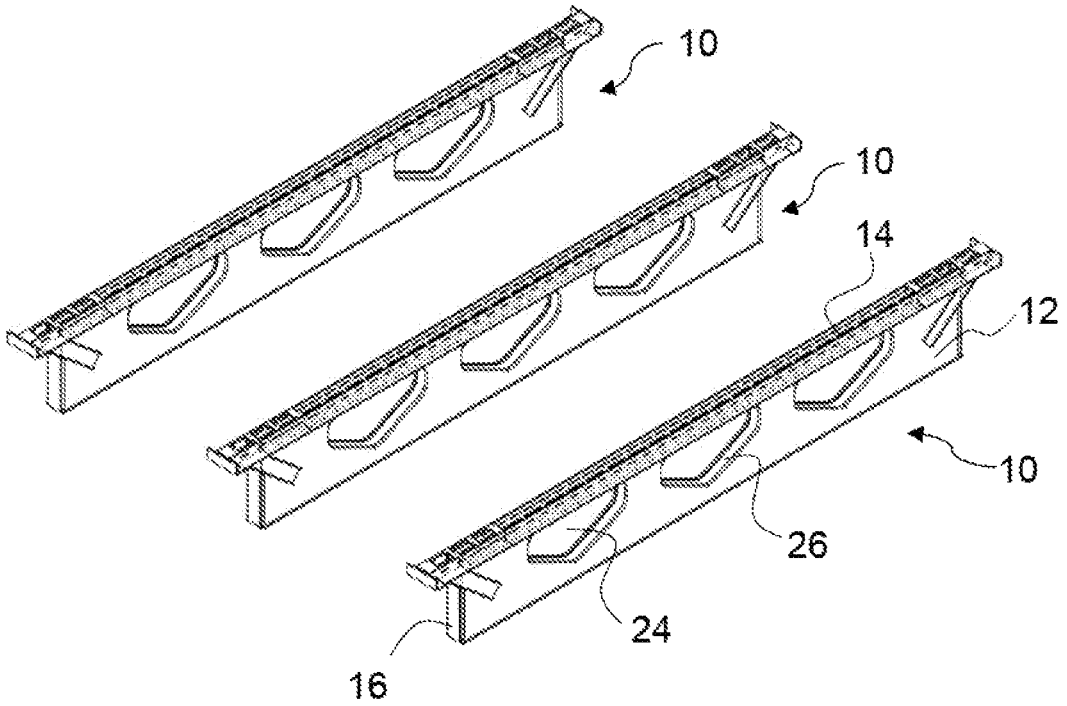
FIG. 1 is a perspective view of a plurality of spaced apart concrete fillable steel joists.

Referring to FIG. 1, a concrete fillable steel joist is shown generally at 10. The concrete fillable steel joist 10 includes a generally U-shaped member 12, a top chord 14, and joist ends. In the embodiment shown in FIGS. 1, 2, 8 and 9 the joist ends are a pair of end plates 16. Alternatively, the joist ends may be a structural member. In the embodiment shown in FIGS. 11-13 the joists ends are another concrete fillable joist 10 and in FIG. 14 the joist end is a steel I-beam. All of the elements of the concrete fillable joist 10 may be made from cold rolled steel.

The generally U-shaped member 12 as best seen in FIGS. 3, 4, 5 and 9 has spaced apart webs 18 and a bottom chord 20. A pair of bottom chord tabs 22 extend outwardly from the bottom chord 20 on either side of the spaced apart webs 18. The U-shaped member includes a plurality of utility holes 24. Each utility hole 24 has a rim 26 that is operably attached to the spaced apart webs 18 around the utility hole 24. The rim 26 is shown in FIG. 10. The rim 26 has a splice 28. The rim 26 around the utility hole 24 of the U-shaped member 12 is operably attached to the webs 18 so that when the concrete fillable joist 10 is filled with concrete, concrete will not be able to flow out of the concrete fillable joist 10 through the utility holes 24.

Figure 7:
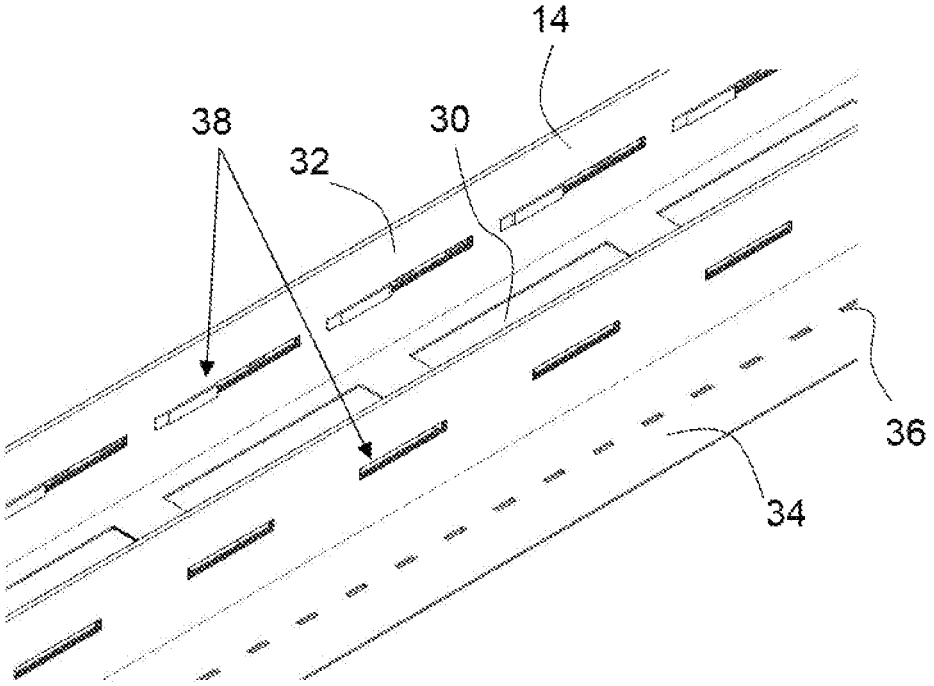
FIG. 7 is an enlarged perspective view of the top chord of the concrete fillable steel joist shown in FIG. 6.

The top chord 14 is operably attached to the U-shaped member 12. The top chord 14 has a plurality of spaced apart top chord holes 30 as best seen in FIG. 7. The top chord 14 has two elongate channels 32 formed therein for receiving the webs 18 of the U-shaped member 12. The top chord 14 includes a pair of side tabs 34 extending outwardly from the elongate channels 32. The side tabs 34 include a plurality of spaced apart tab holes 36. The elongate channels 32 are clinched 38 to the web 18 of the U-shaped member 12. It will be appreciated by those skilled in the art that the top chord could be attached to the U-shaped member in a number of different ways, for example, riveting, welding or clinching as shown herein.

Figure 8:
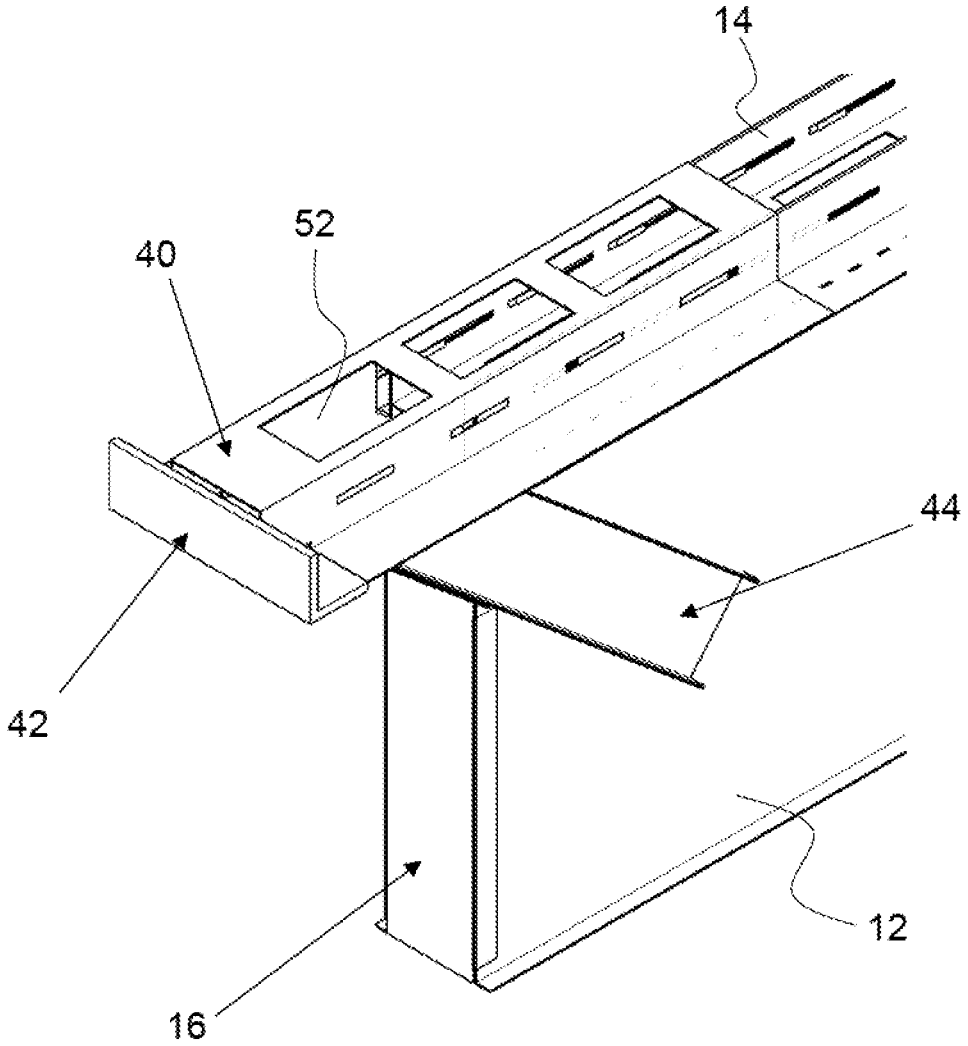
FIG. 8 is an enlarged perspective view of one end of the concrete fillable steel joist of FIG. 1.
Figure 9:
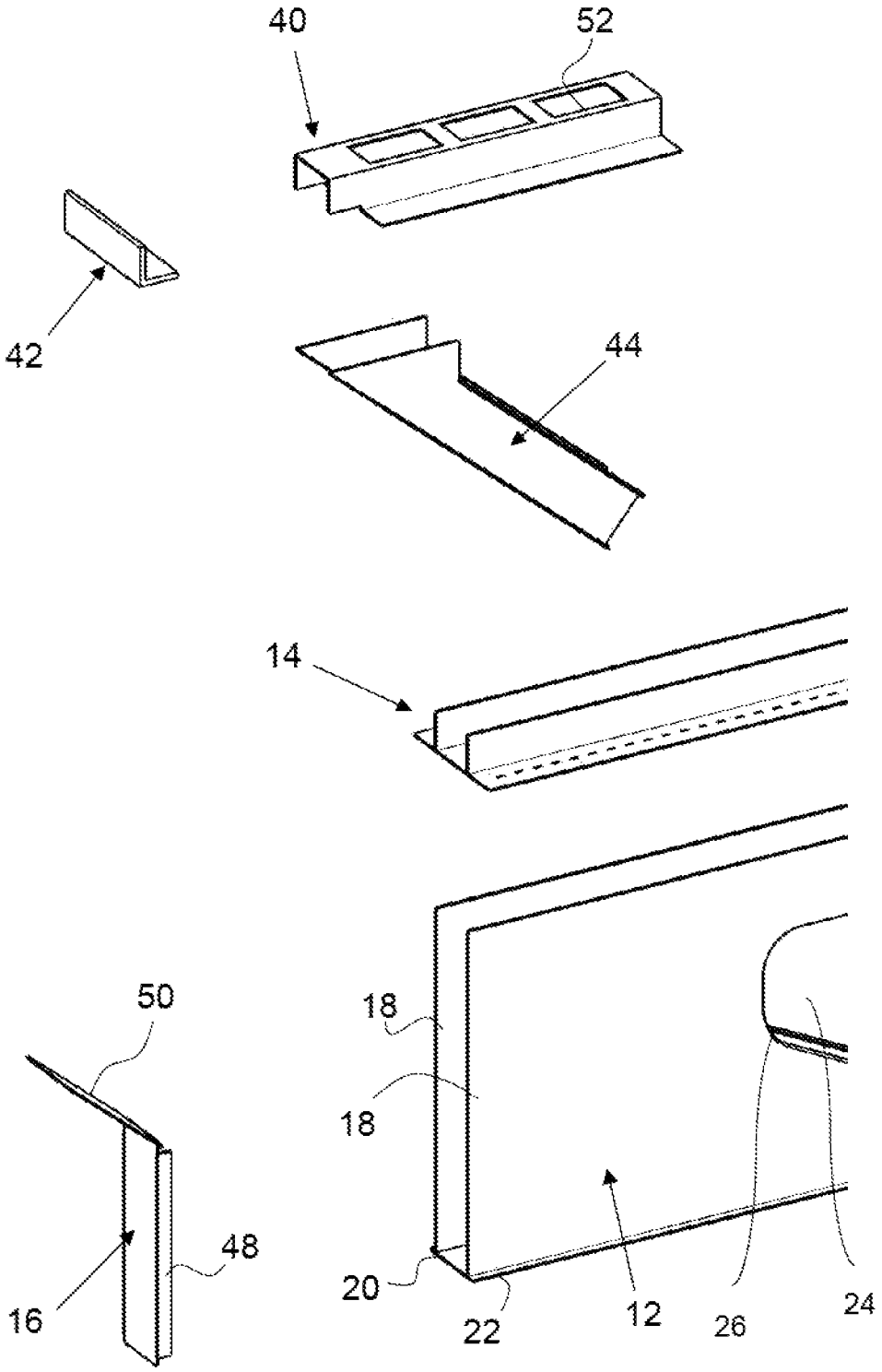
FIG. 9 is a blown apart perspective view of one end of the concrete fillable steel joist shown in FIG. 8.
Figure 10:
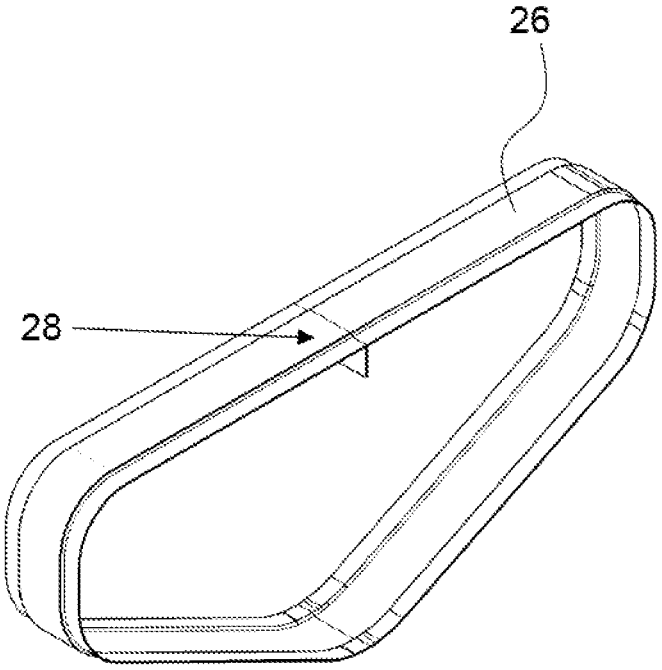
FIG. 10 is an enlarged perspective view of a rim for use in the concrete fillable steel joist of FIG. 1.

Referring to FIGS. 8 and 9, the concrete fillable joist 10 shown herein is a top chord type joist. Concrete fillable joist 10 has a pair of end plates 16 operably attached at opposed ends of U-shaped member 12. A pair of joist support struts 40 are attached to opposed ends of the top chord 14 and extending outwardly from the U-shaped member 12. A pair of joist shoes 42 are attached to each of the joist support struts 40 at a distal end thereof. A pair of joist diagonal members 44 are attached on either side of the U-shaped member 12 and are operably attached to the U-shaped member 12 and the joist support strut 40. A pair of the joist diagonal members 44 are operably attached at opposed ends of the U-shaped member 12. The end plates 16 have a generally vertical portion 48 and an angled portion 50. The angled portion 50 is generally in registration with the pair of joist diagonal members 44. The joist support strut 40 has a plurality of spaced apart strut holes 52.

Figure 11:
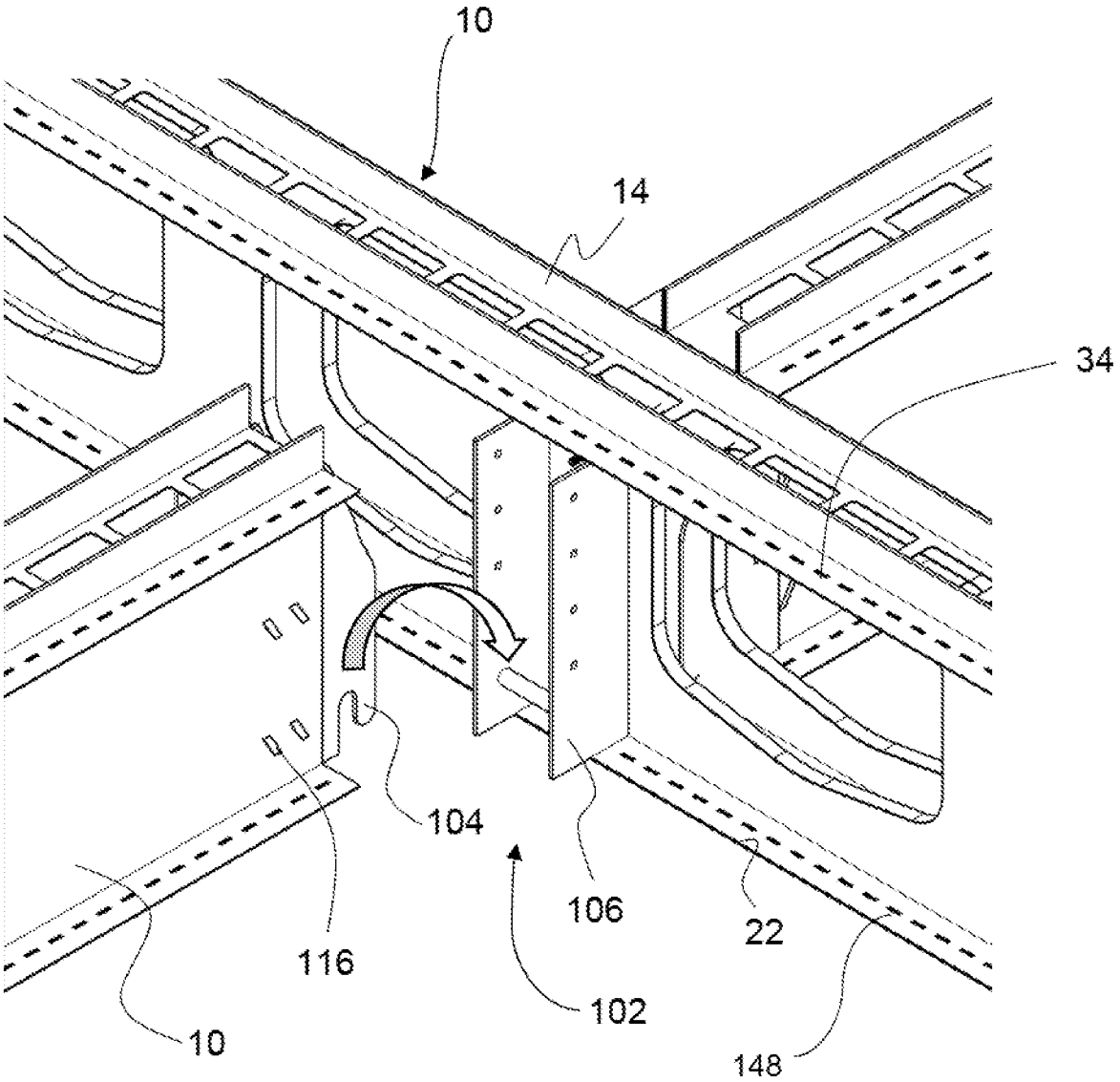
FIG. 11 is a perspective view of a first concrete fillable steel joist and showing a blown apart joist moment connector assembly for attaching a second concrete fillable steel joist perpendicular to the first concrete fillable steel joist.
Figure 12:
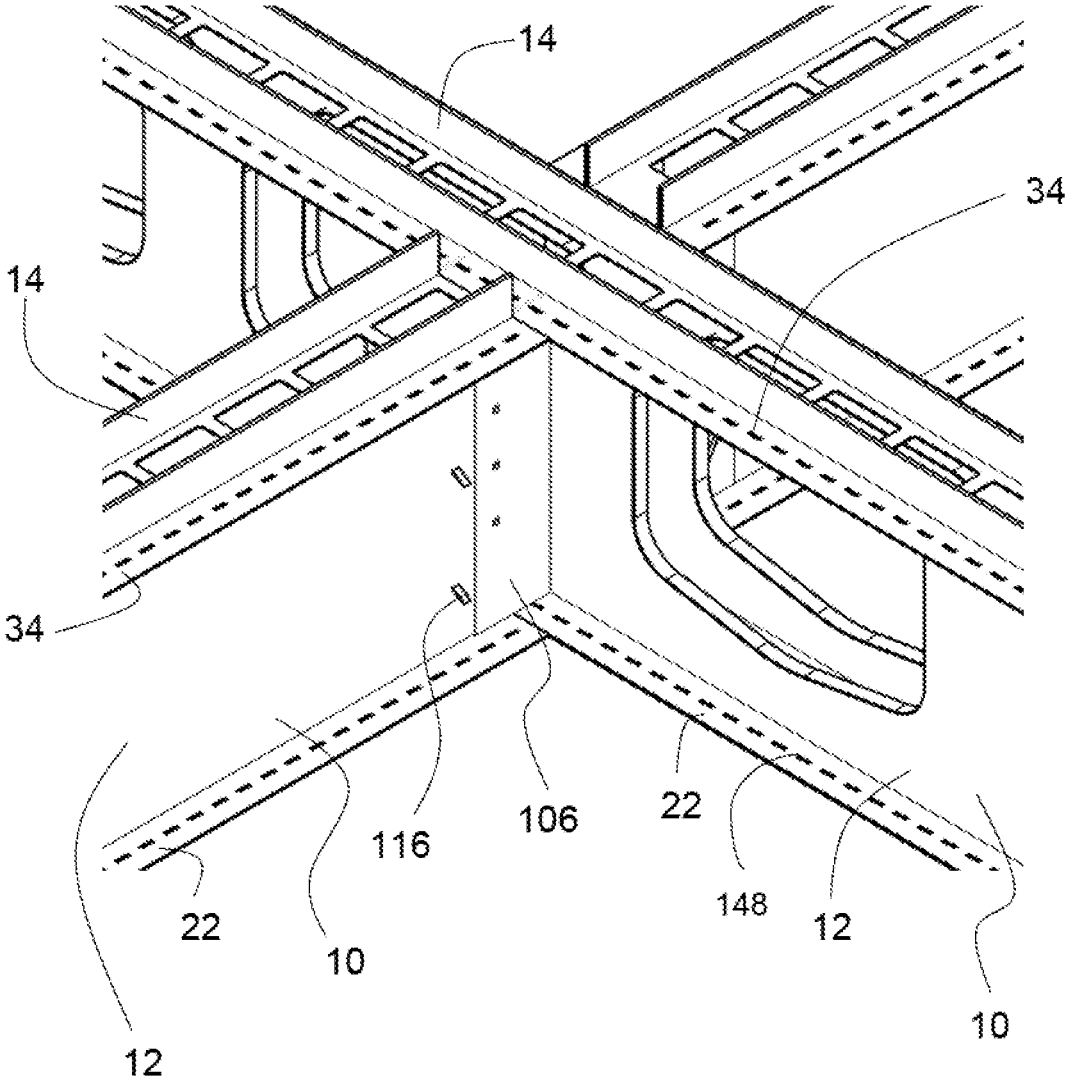
FIG. 12 is a perspective view of the assembled joist moment connector assembly connecting a first and second concrete fillable steel joist.
Figure 13:
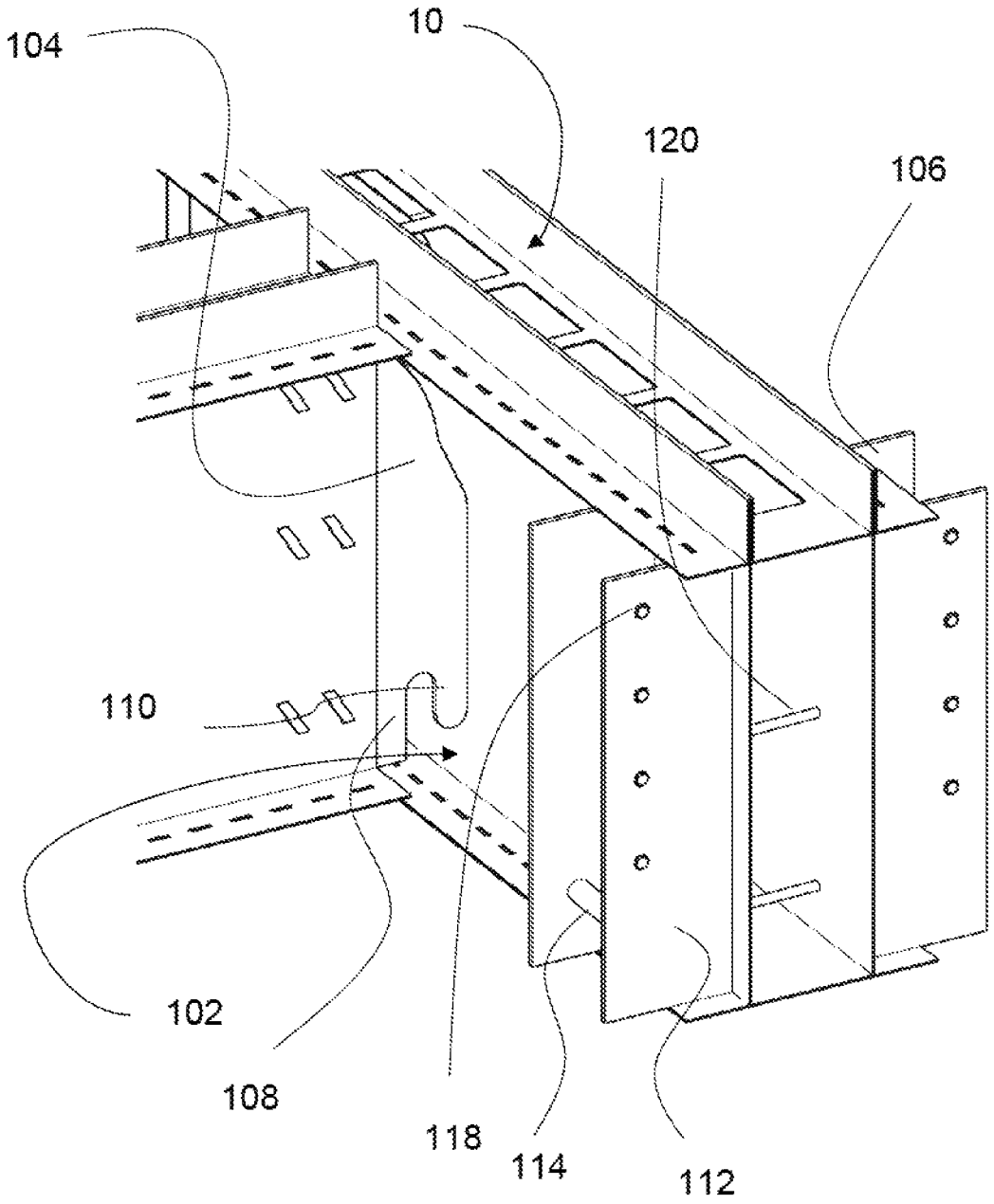
FIG. 13 is a blown apart perspective view of the joist moment connector assembly attached to a concrete fillable steel joist.
Figure 14:
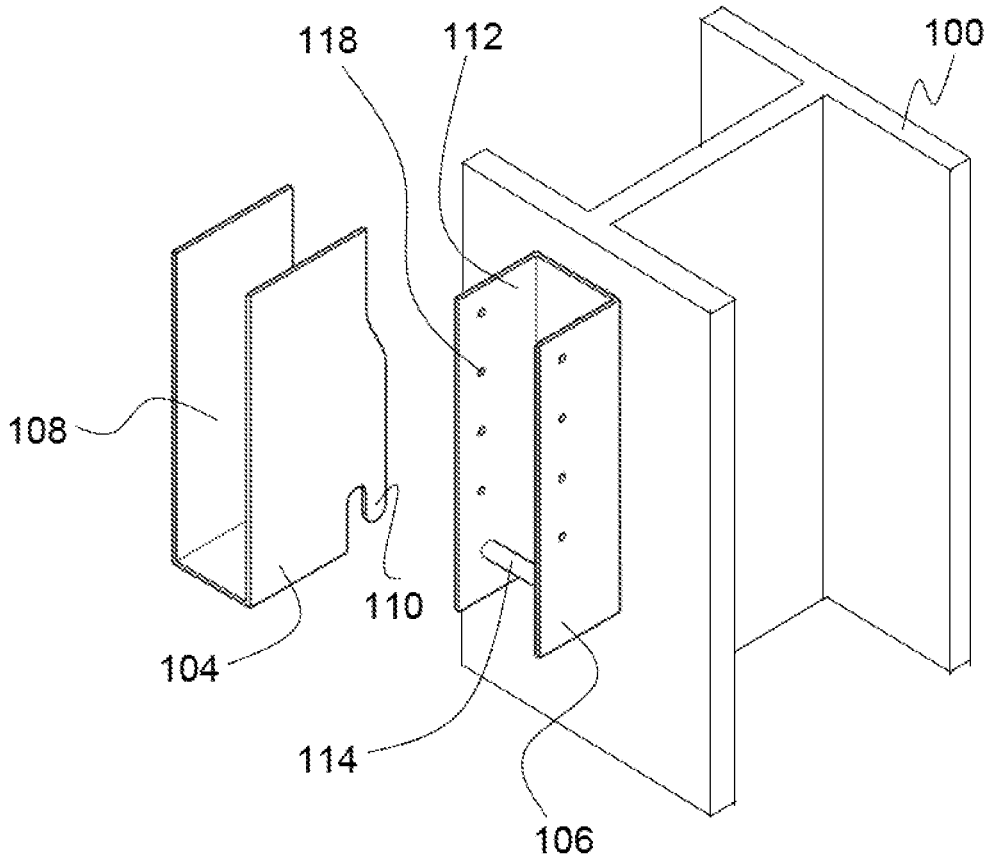
FIG. 14 is a blown apart perspective view of the joist moment connector assembly attached to a steel I-beam.

Referring to FIGS. 11 to 14, the concrete fillable joist 10 may have one or both joist ends as a structural member. The concrete fillable steel joist 10 is attached to a structural member such that when filled with concrete the end of the fillable volume defined by the concrete fillable joist is the structural member. In the embodiments shown herein the structural member may be another concrete fillable joist 10 as shown in FIGS. 11-13. Alternatively, the structural member may be a steel I-beam 100 as shown in FIG. 14. In the embodiment shown herein, the concrete fillable joist 10 is connected to the structural member with a joist moment connector assembly 102.

In the embodiment shown herein, the joist moment connector assembly 102 includes a hook member 104 and support member 106. Hook member 104 has an attachment portion 108 and hook portion 110. The attachment portion 108 is generally U shaped and fits inside the U-shaped member 12 and is welded thereto. The attachment portion 108 and the hook portion 110 of the hook member 104 are formed from a single piece of steel. Support member 106 has an attachment portion 112 and a support bar 114. The attachment portion 112 of the support member 106 is generally an elongate C-shaped member. Support member 106 is configured to fit outside of U-shaped member 12 when the joist moment connector 102 is assembled as shown in FIG. 12. U-shaped member 12 is provided with punch outs 116 proximate to the distal end thereof. The punch outs 116 are to facilitate welding of support member 106 to the concrete fillable joist 10. Support member 106 has a plurality of screw holes 118 whereby when the joist moment connector assembly is in position screws (not shown) are used to hold the concrete fillable joist 10 in position.

Support member 106 of the joist moment connector assembly 102 is attached to a support member. In the embodiments shown herein the support members are another concrete fillable joist 10 as shown in FIG. 11 to 13 or alternatively to a steel I-beam 100 as shown in FIG. 14. The support member 106 may be bolted 120 to a concrete fillable joist 10 as best seen in FIG. 13. Alternatively, the support member 106 may be welded to the support member as shown in FIG. 14 wherein it is welded to an I-beam 100.

Figure 2:
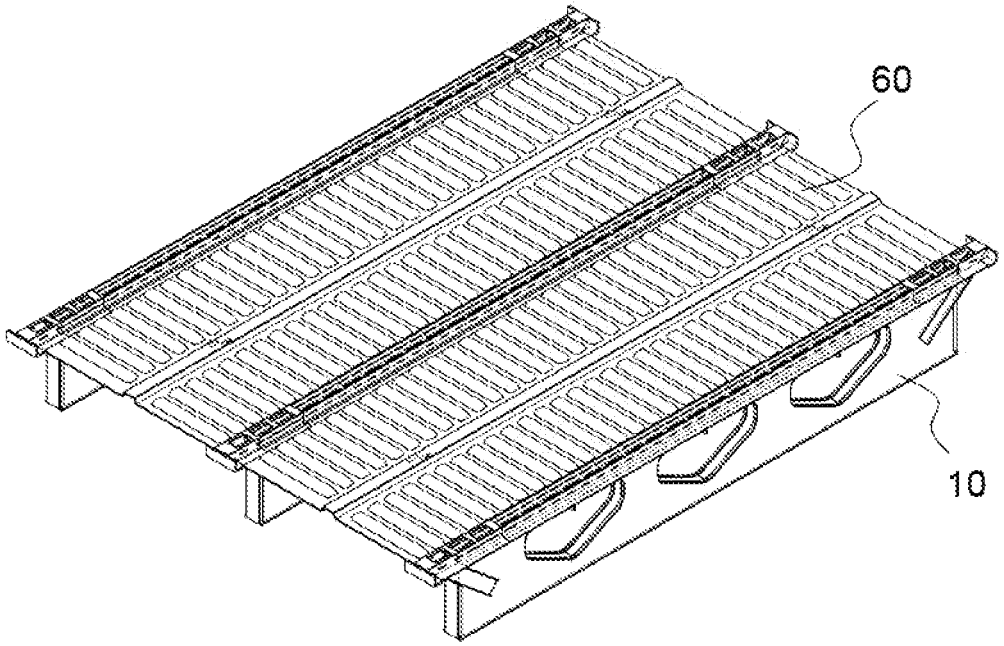
FIG. 2 is a perspective view similar to that shown in FIG. 1 of a plurality of spaced apart concrete fillable steel joists but also including metal decking between the spaced apart concrete fillable steel joists.
Figure 3:
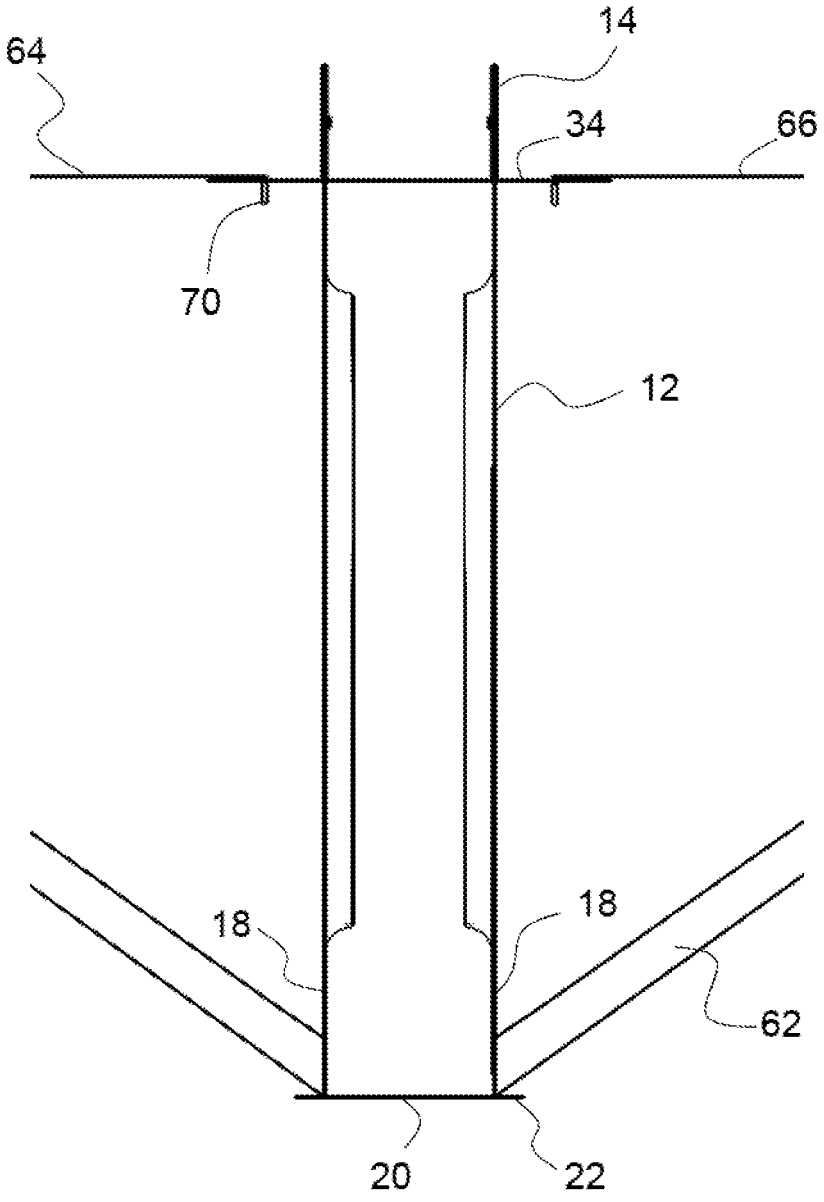
FIG. 3 is a cross sectional view of a concrete fillable steel joist of FIG. 1.
Figure 17:
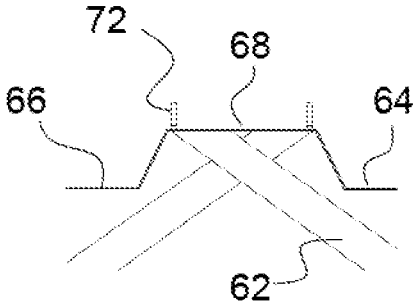
FIG. 17 is an enlarged side view of the concrete fillable steel joist system of FIG. 15 showing the connection between the metal decking.
Figure 16:
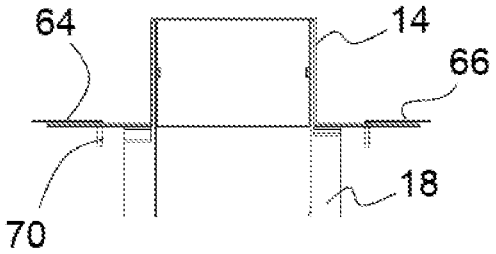
FIG. 16 is an enlarged side view of the concrete fillable steel joist system of FIG. 15 showing the top chord of a concrete fillable steel joist and the metal decking.
Figure 15:
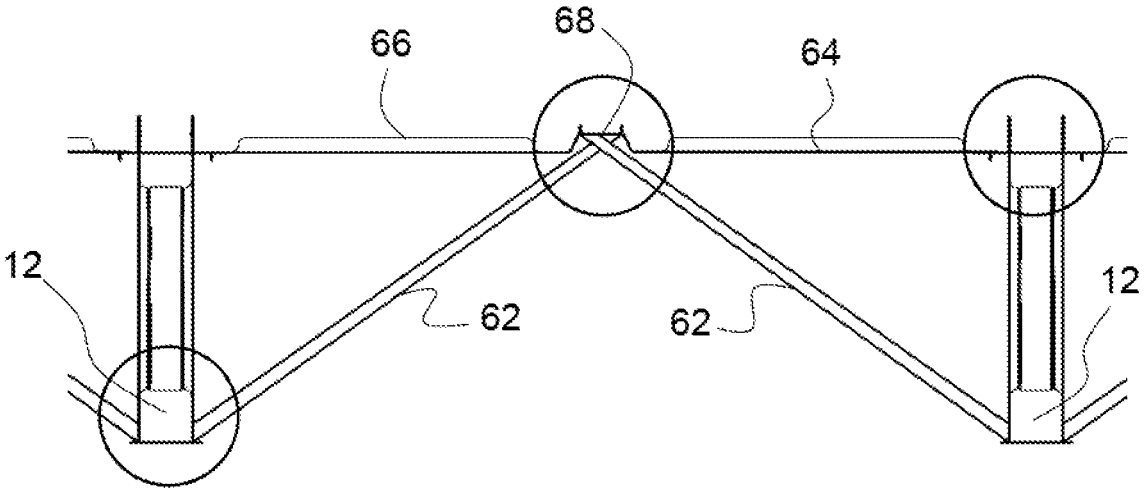
FIG. 15 is a side view of a concrete fillable steel joist system including two spaced apart concrete fillable steel joists, metal decking and bridging.
Figure 18:
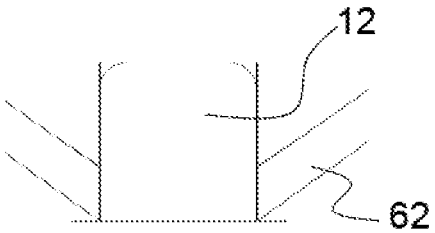
FIG. 18 is an enlarged side view of the concrete fillable steel joist system of FIG. 15 showing the connection between a concrete fillable steel joist and the bridging connections.
Figure 19:
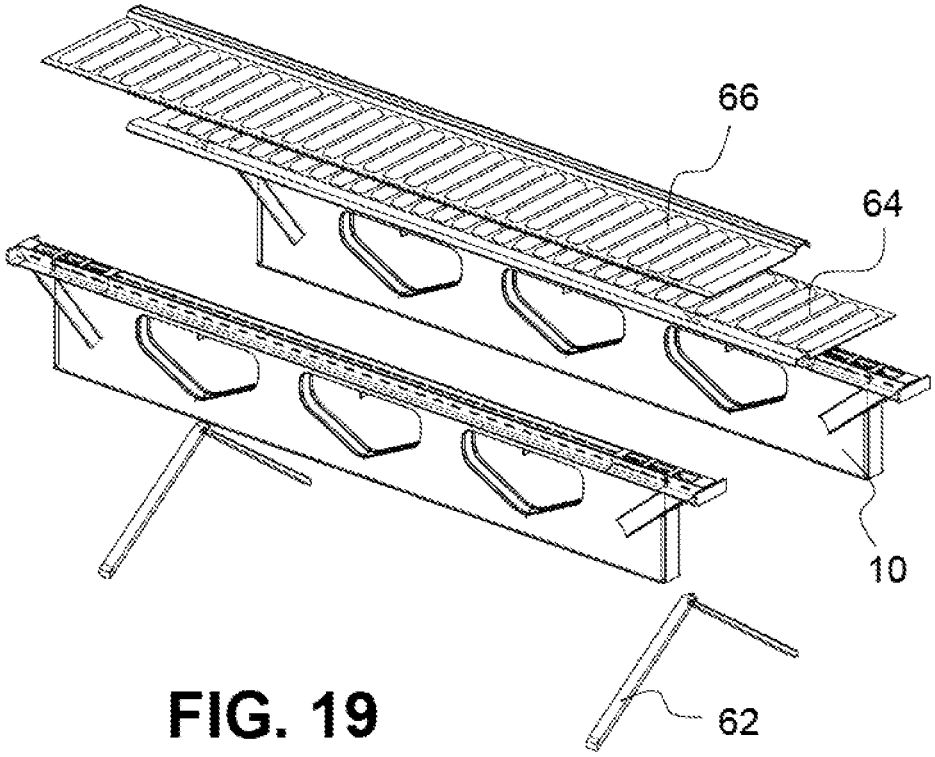
FIG. 19 is a blown apart perspective view of a concrete fillable steel joist system.
Figure 20:
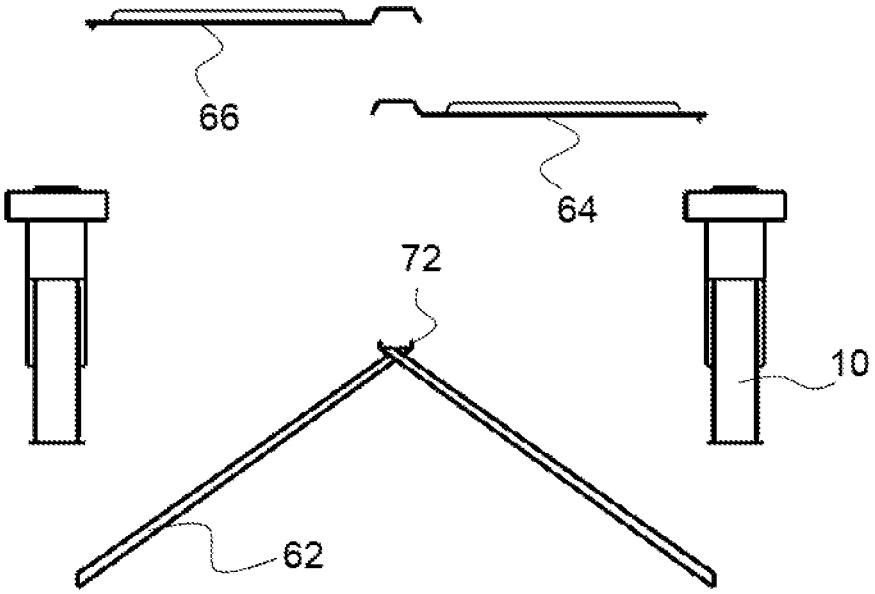
FIG. 20 is a blown apart end view of the concrete fillable steel joist system of FIG. 19.
Figure 21:
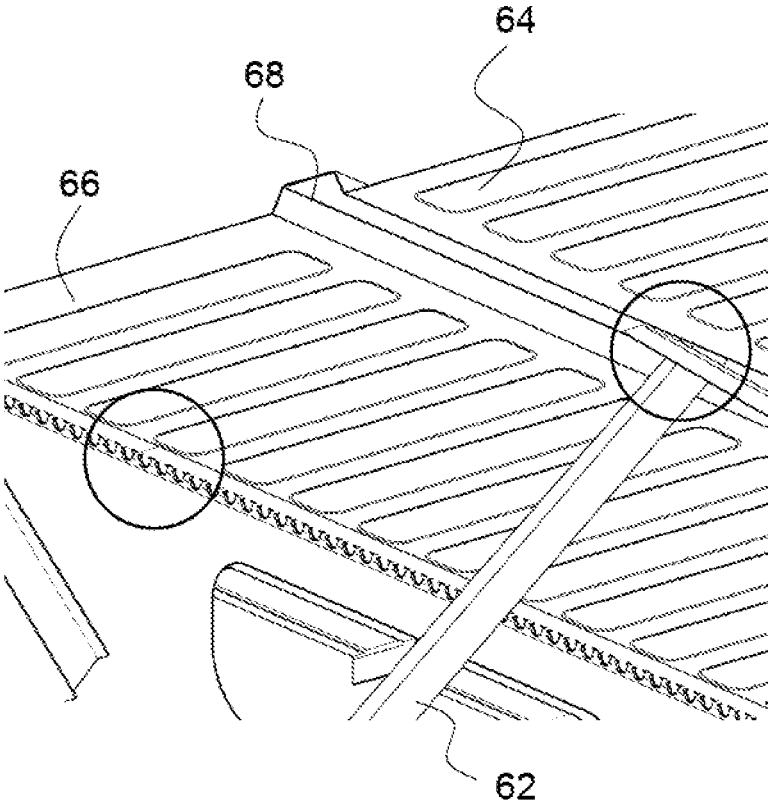
FIG. 21 is an enlarged perspective view of the underside of the concrete fillable steel joist system of FIGS. 19 and 20.
Figure 22:
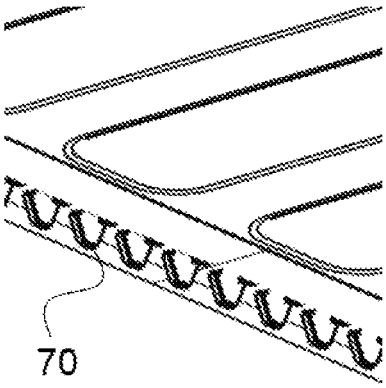
FIG. 22 is an enlarged perspective view of FIG. 21 showing decking tabs pushed through the top chord of the concrete fillable steel joist.
Figure 23:
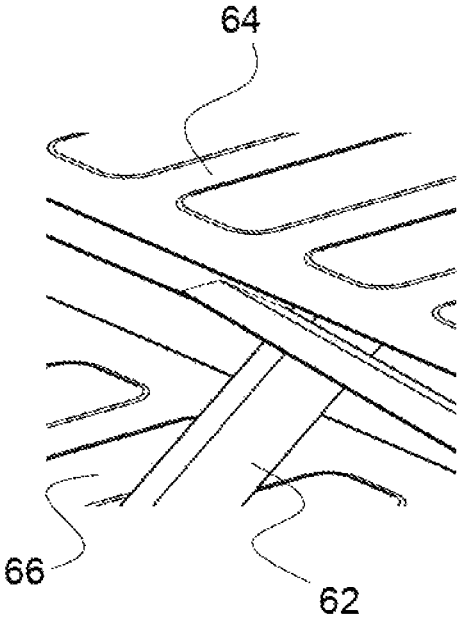
FIG. 23 is an enlarged perspective view of FIG. 21 showing the bridging support and metal decking between adjacent concrete fillable steel joists.
Figure 24:
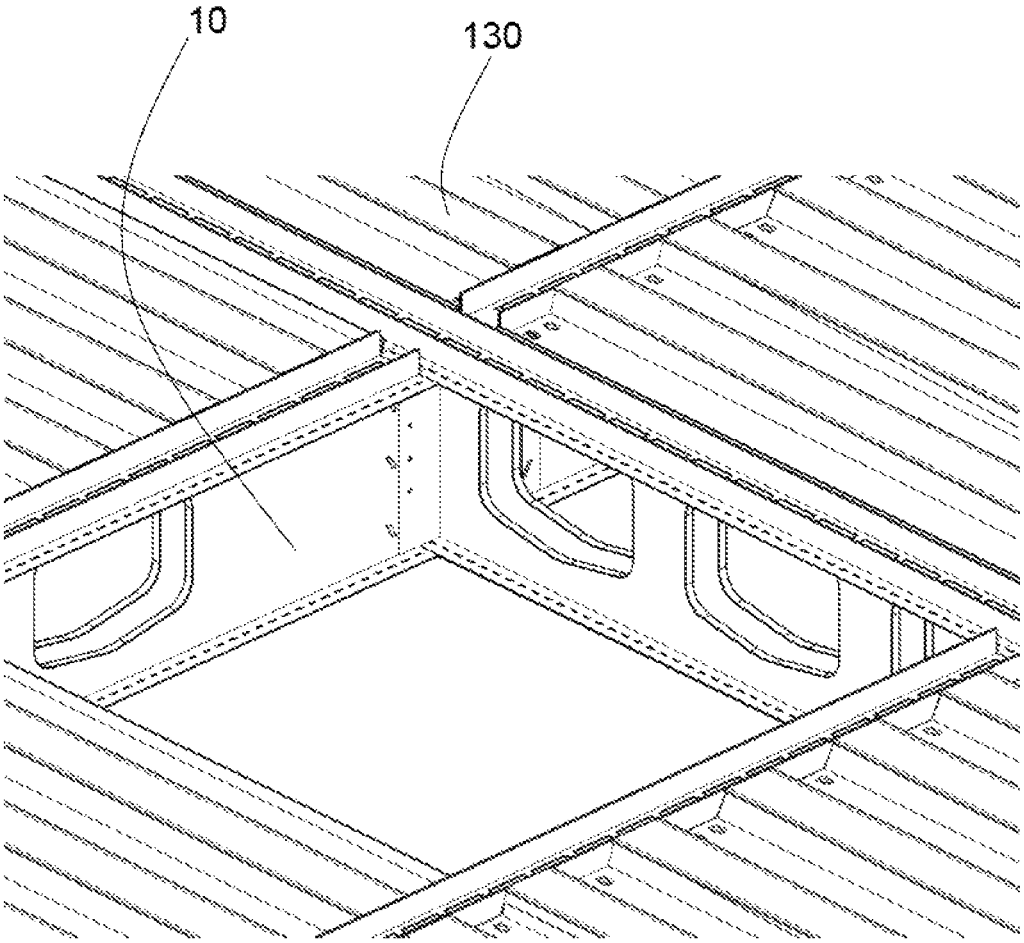
FIG. 24 is a perspective view of a concrete fillable steel joist system similar to that shown in FIG. 2 but showing an alternate steel decking and showing a portion of the metal decking removed to show the concrete fillable steel joists.
Figure 25:
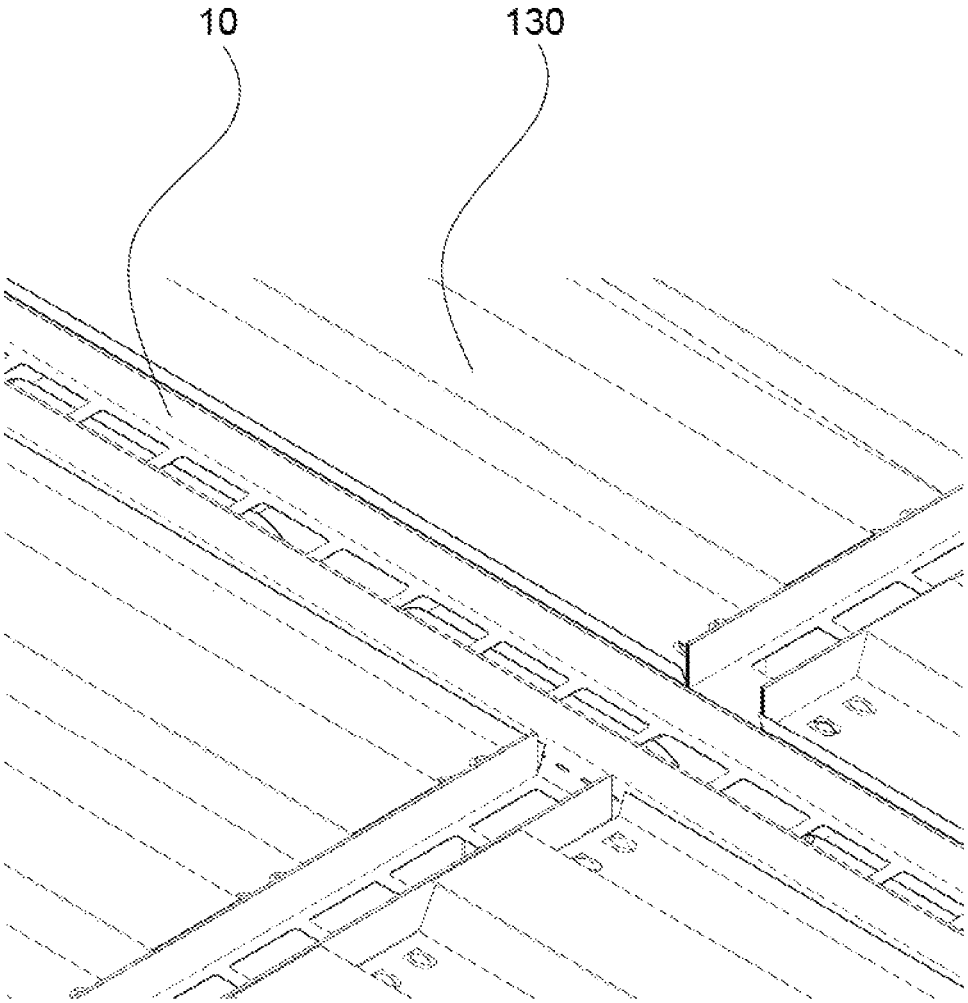
FIG. 25 is a perspective view showing the concrete fillable steel joist system of FIG. 24.
Figure 26:
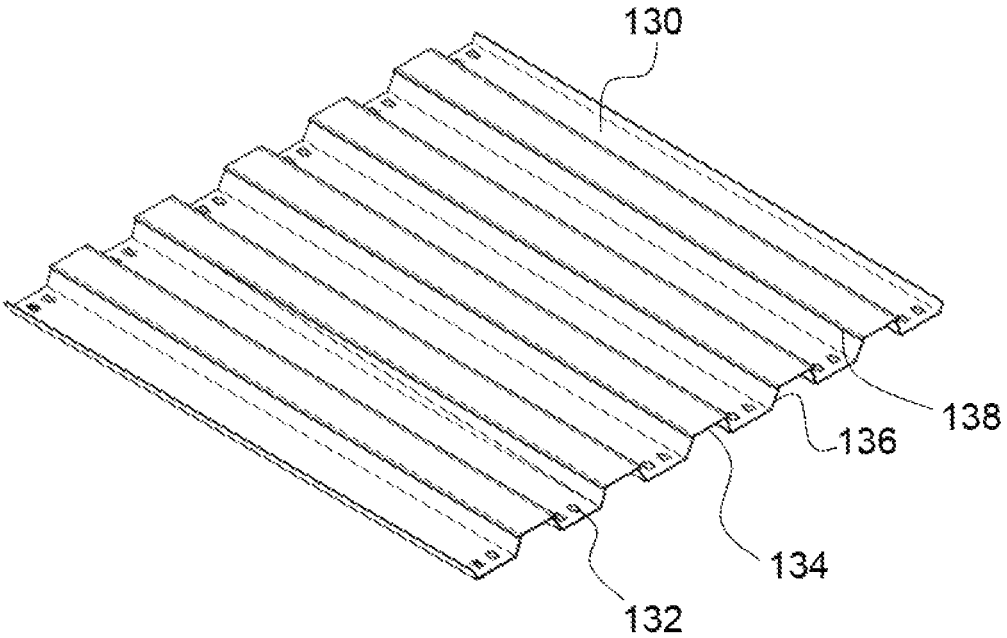
FIG. 26 is a perspective view of the steel decking shown in FIGS. 24 and 25.
Figure 27:
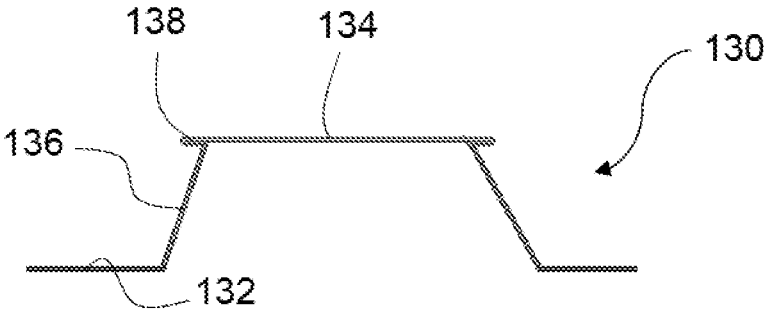
FIG. 27 is a side view of the steel decking shown in FIG. 26.

The concrete fillable steel joists 10 are for use in a concrete fillable steel joist system. The concrete fillable steel joist system includes a plurality of spaced apart concrete fillable steel joists 10, metal decking 60 and bridging members 62 as best seen in FIGS. 2, 19 and 20. The metal decking 60 is operably attached to the spaced apart concrete fillable joists 10. The metal decking 60 includes a first and second metal deck portions 64, 66 which are operably connected to each other. One of the first and second metal deck portions 64, 66 is attached to one side to the concrete fillable steel joist 10 and the other of the first and second metal deck portions 64, 66 is attached to the other side to the other of the concrete fillable steel joist 10. The first and second metal deck portions 64, 66 of two distinct concrete fillable steel joists 10 are operably connected together with an overlapping joint 68 as best seen in FIG. 17. A plurality of decking tabs 70 extend downwardly from the first and second decking portions 64, 66, as shown in FIG. 16. The tab holes 36 on the tabs 34 of the top chord 14, best seen in FIG. 7, are configured to receive the decking tabs 70 therethrough.

The bridging members 62 are operably attached between the metal decking 60 and the U-shaped member 12 of the concrete fillable steel joist 10. The bridging members 62 extend between the bottom chord of the U-shaped member 12 to the overlapping joint 68. The bridging members 62 have bridging tabs 72 that extend upwardly. The bridging tabs 72 engage holes formed in the first and second metal deck portions 64, 66 in the overlapping joint zone 68.

An alternate embodiment of a concrete fillable steel joist system is shown in FIGS. 24 to 33. The system is similar to that described above but with an alternate metal decking 130.

Decking 130 has a plurality of spaced apart elongate bottom flanges 132, a plurality of spaced apart elongate top flange 134 and a plurality of elongate webs 136 extending outwardly and downwardly from a top flange 134 to a bottom flange 132. Each top flange 134 has a re-entrant lip 138 that extends outwardly from the top flange 134 and generally in the same plane as the top flange 134.

Figure 30:
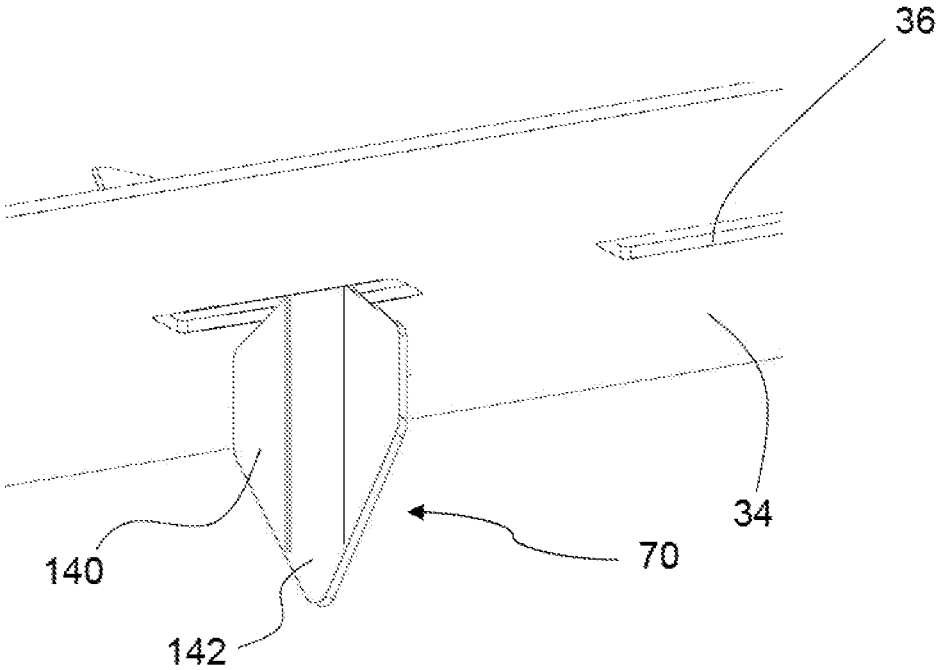
FIG. 30 is an enlarged perspective view showing the decking tabs inserted into the tab holes on the top chord.
Figure 31:
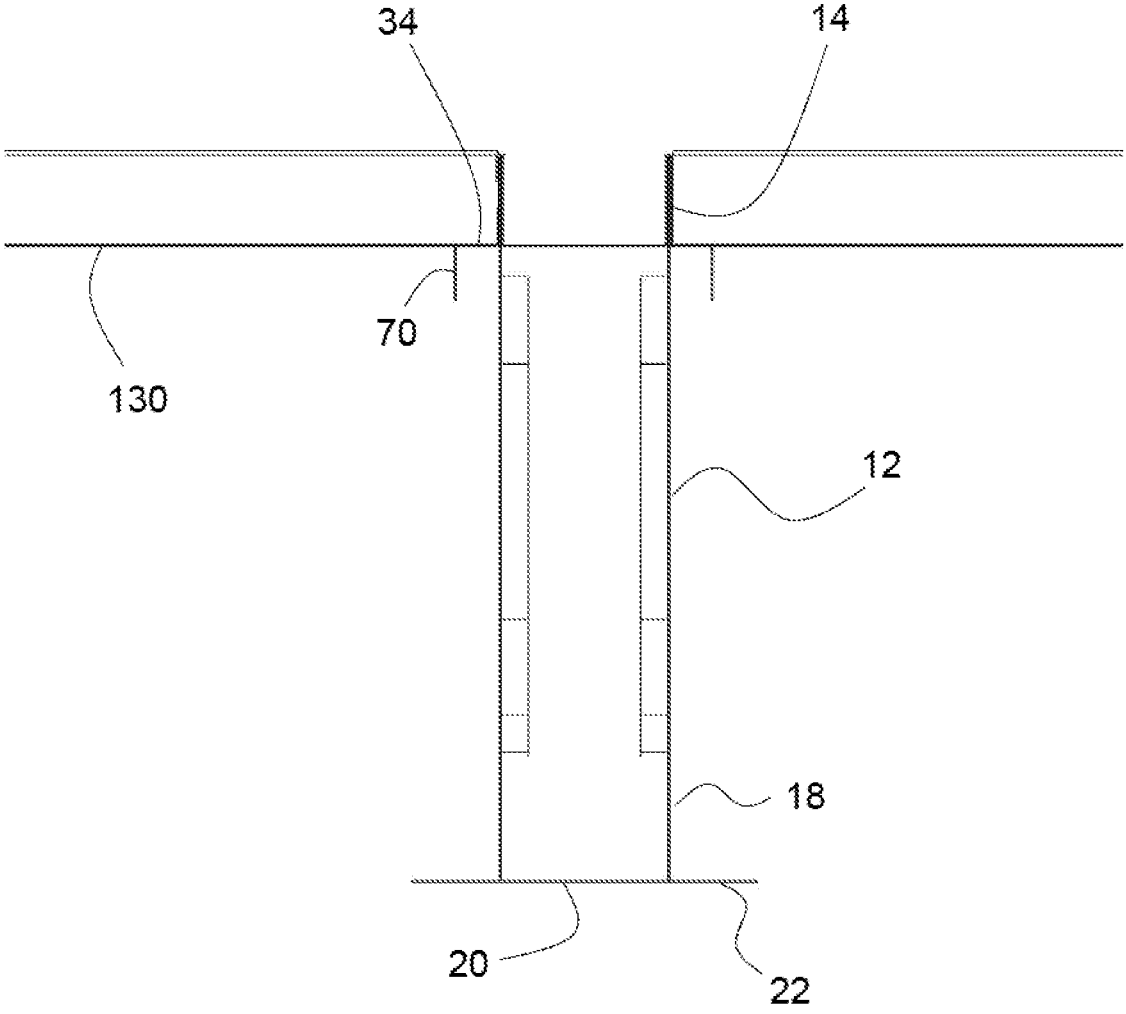
FIG. 31 is a side view of the concrete fillable steel joist system of FIGS. 24 and 25.

Decking 130 has a plurality of spaced apart decking tabs 70 proximate to the sides thereof as described above. The decking tabs 70 may be push-down tabs such that only those that are used on site are pushed down. Decking tabs 70 may include a pair of wings 140 and a central portion 142 such that once decking tab 70 is in place the wings 140 may be bent to hold the tab 70 in place as best seen in FIG. 30. Decking tabs 70 are configured to fit through the spaced apart tab holes 36 in side tabs 34 of top chord 14.

Figure 28:
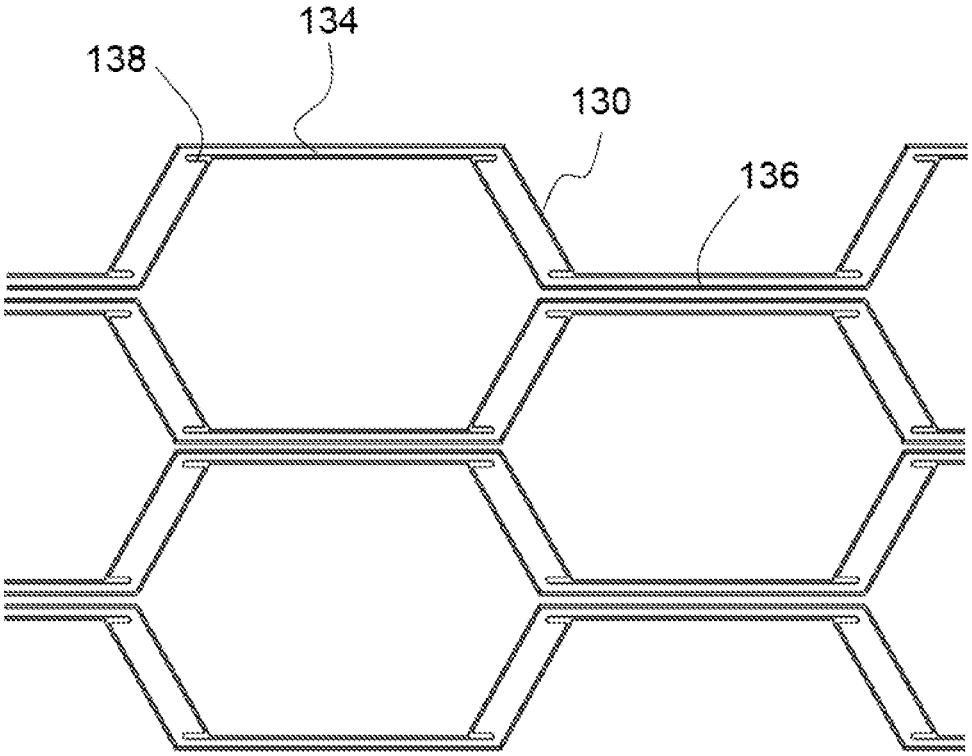
FIG. 28 is a side view of a plurality of the steel decking nested for shipping.
Figure 29:
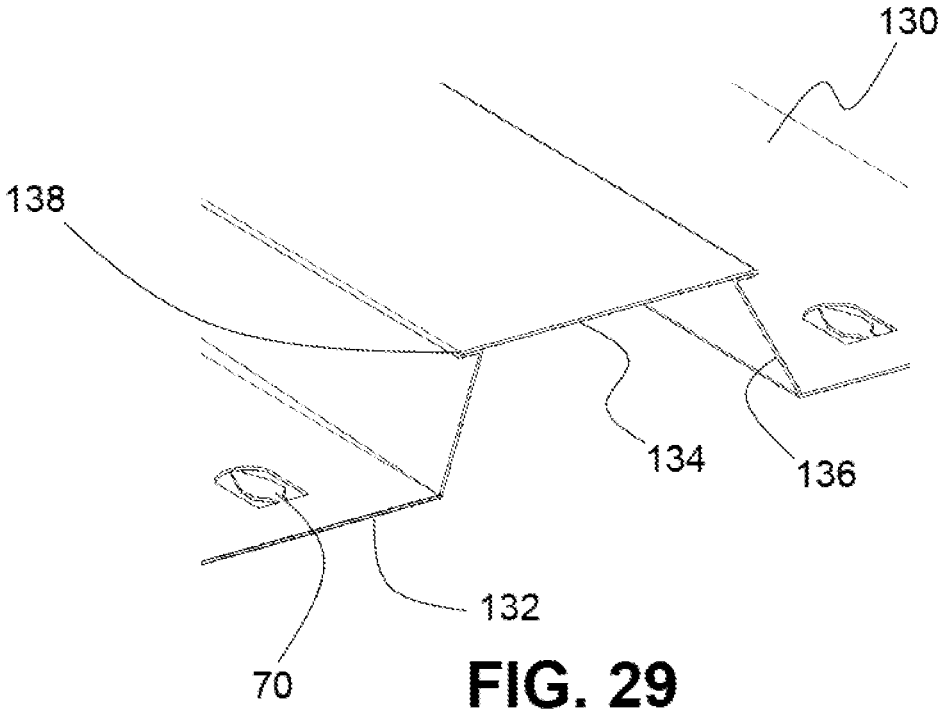
FIG. 29 is an enlarged perspective view of the steel decking of FIG. 26 and showing the decking tabs.
Figure 32:
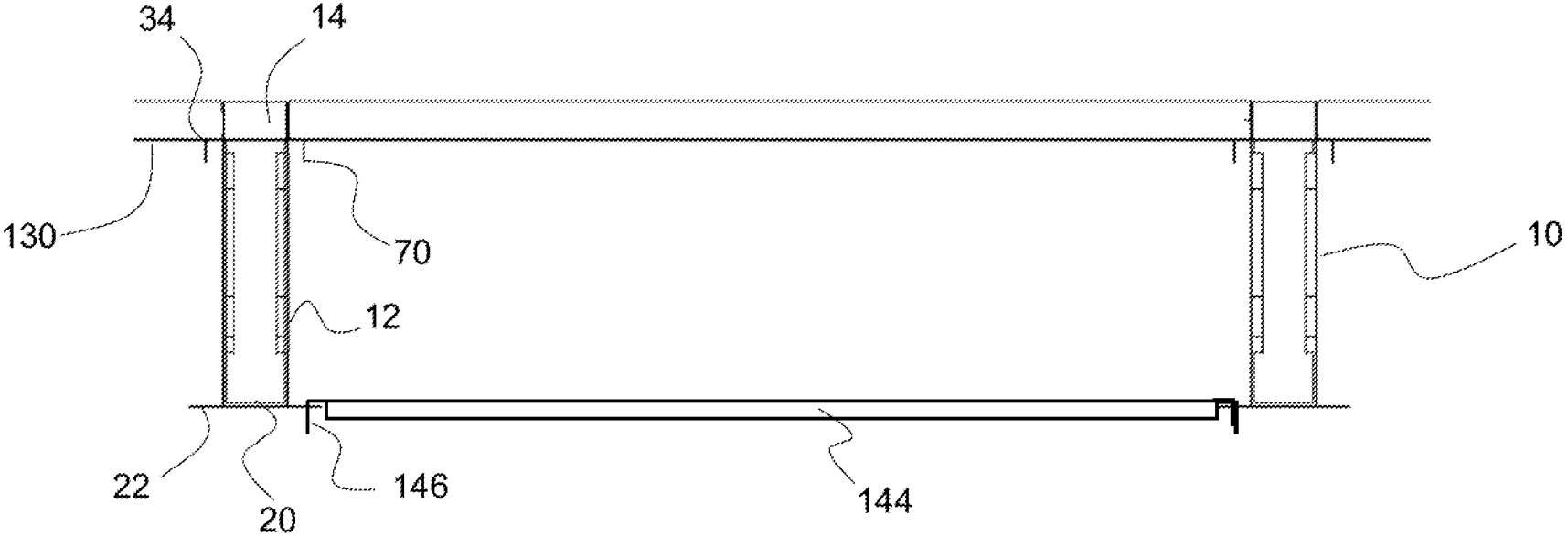
FIG. 32 is a side view of the concrete fillable steel joist system similar to that shown in FIG. 31 but also showing a bridging member.
Figure 33:
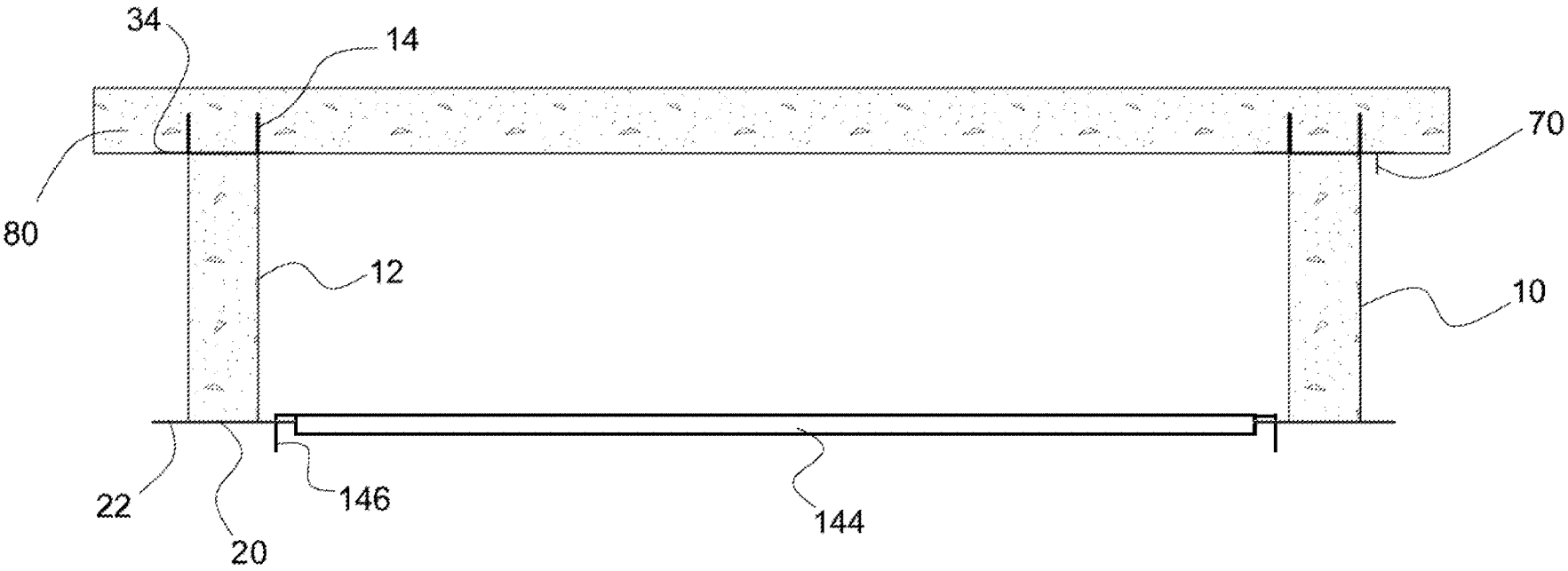
FIG. 33 is a side view of the concrete fillable steel joist system similar to that shown in FIG. 32 showing it filled with concrete.

In one embodiment the width of the width of the top flange 134 and the pair of re-entrant lips 138 is less than the width of bottom flange 132. This allows metal decking 130 to be nested together for shipping as shown in FIG. 28. Decking 130 may be used in conjunction with lower bridging members 144, as shown in FIG. 32. Lower bridging members 144 extend between adjacent concrete fillable joists 10. Lower bridging members include lower bridging tabs 146 that are configured to fit through bottom chord holes 148 (best seen in FIGS. 11 and 12) in bottom chord tab 22 of U-shaped member 12.

In use, elements of the concrete fillable steel joist 10 in combination with the metal decking 60 provide a stay in place forming system that is fillable with concrete 80. Prior to filling the concrete fillable steel joist 10 with concrete the concrete fillable steel joist 10 is cambered. During fabrication the concrete fillable steel joist 10 is cambered so that the concrete fillable steel joist system is not required to be shored up to support the system during the concrete pour.

Figure 4:
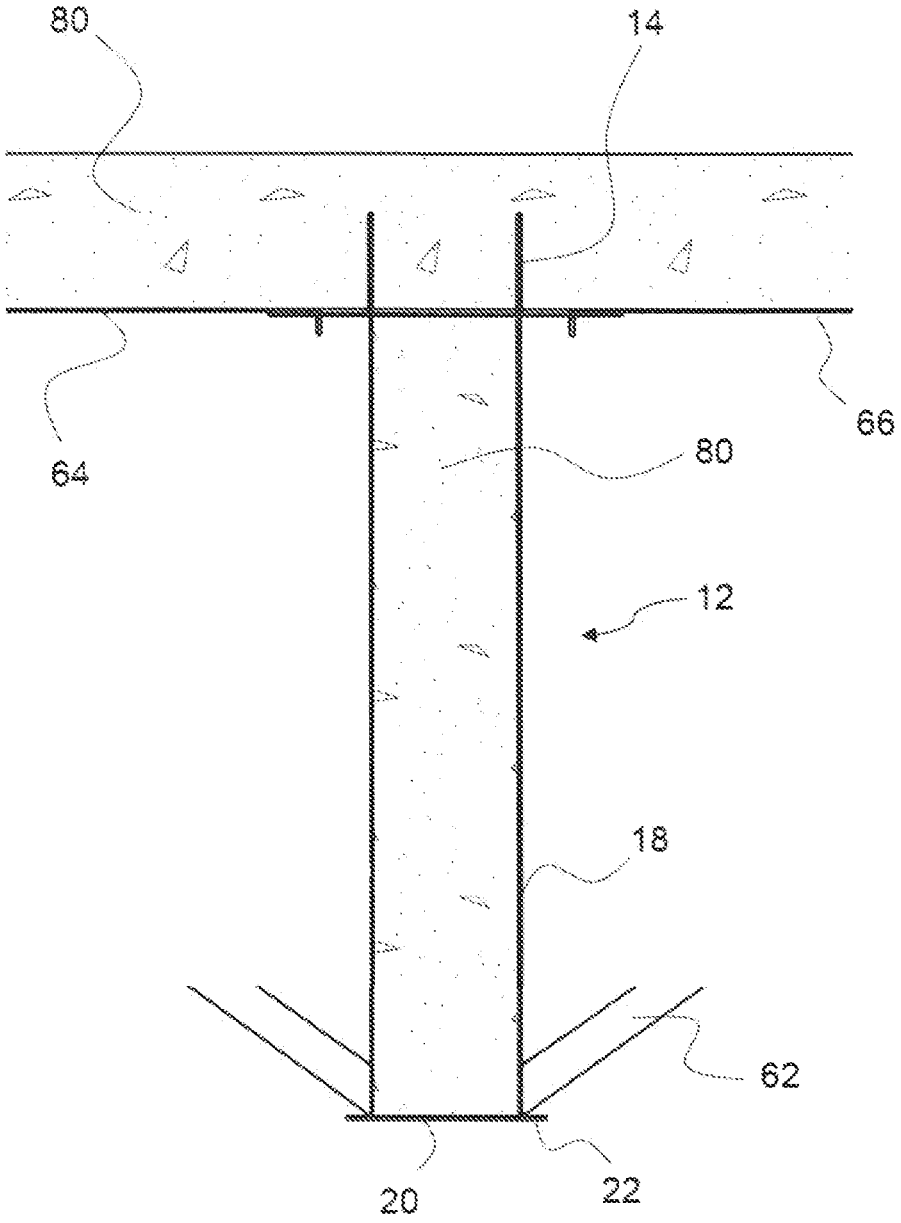
FIG. 4 is a cross sectional view similar to that of FIG. 3 showing a concrete fillable steel joist but showing it filled with concrete.
Figure 5:
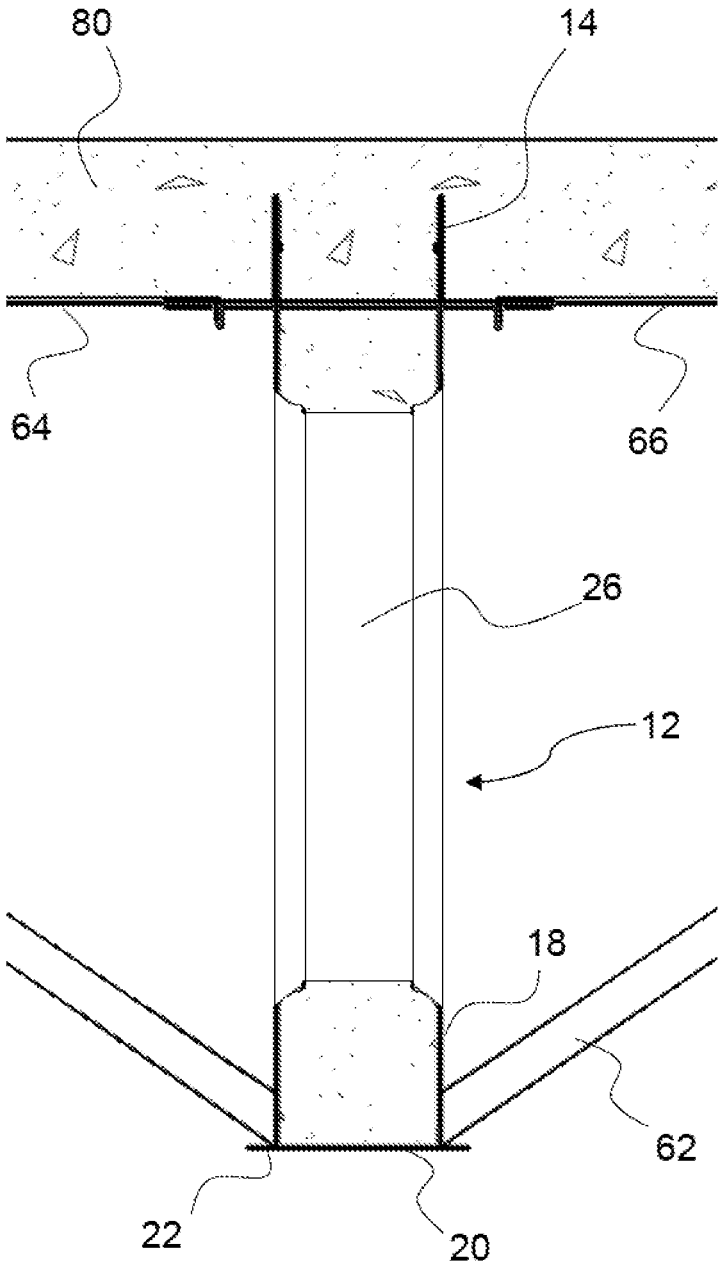
FIG. 5 is a cross sectional view similar to that of FIG. 4 but the section is through a utility hole.
Figure 6:
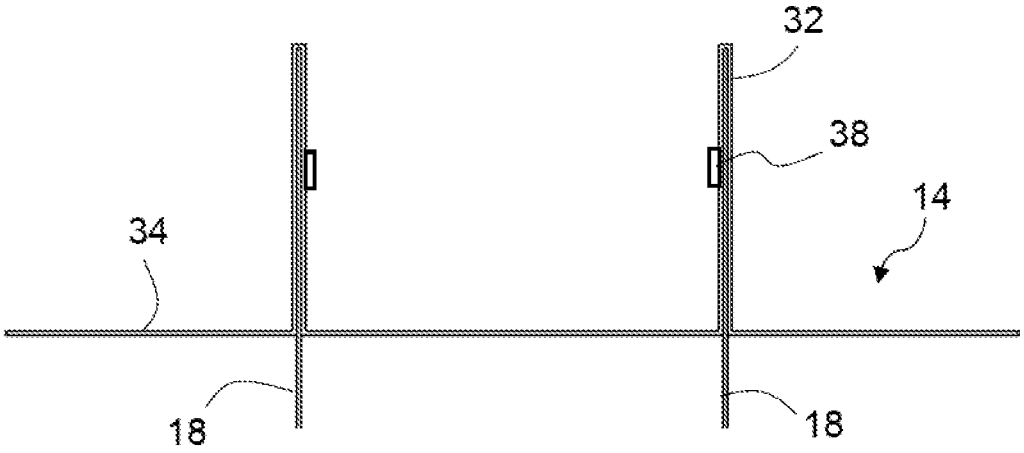
FIG. 6 is an enlarged cross-sectional view of a top chord of a concrete fillable steel joist of FIG. 1.

It will be appreciated by those skilled in the art that the concrete fillable steel joists 10 may be constructed off site. When the concrete fillable joists 10 are brought on to the construction site, the first and second metal deck portions 64, 66 are hooked onto each of the concrete fillable joists 10 and the bridging members are engaged. Once the element of the concrete fillable steel joist system is in place concrete may then be poured. As can be seen in FIGS. 4 and 5 the concrete fillable steel joist 10 and metal decking 60 and concrete 80 all work together. The utility holes 24 with the rims 26 effectively lock the steel web 18 of the joist in with the concrete 80 and the top chord holes 30 and clinching 38 effectively lock in with the concrete so that all elements work in composite action. Similarly, the re-entrant lips 138 of metal decking 130 effectively lock the concrete to the decking 130.

Generally speaking, the systems described herein are directed to concrete fillable steel joists. Various embodiments and aspects of the disclosure are described in the detailed description. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein the "operably connected" or "operably attached" means that the two elements are connected or attached either directly or indirectly. Accordingly, the items need not be directly connected or attached but may have other items connected or attached therebetween.

What is claimed is:

1. A concrete fillable steel joist comprising:

a generally U-shaped member having spaced apart webs and a bottom chord;

a top chord operably attached to the U-shaped member, the top chord having a plurality of spaced apart top chord holes and having two elongate channels formed therein for receiving the spaced apart webs of the U-shaped member;

whereby the U-shaped member and the top chord define a volume that is fillable with concrete when opposed ends of the U-shaped member have joist ends operably attached thereto; and whereby the concrete fillable steel joist is cambered.

2. The concrete fillable steel joist as claimed in claim 1 wherein at least one of the joist ends is a structural member.

3. The concrete fillable steel joist as claimed in claim 2 further including a joist moment connector assembly.

4. The concrete fillable steel joist as claimed in claim 3 wherein the joist moment connector assembly includes a hook member operably attached to one of the U-shaped member and the structural member and a rod member operably attached to the other of the U-shaped member and the structural member and the hook member engages the rod member.

5. The concrete fillable steel joist as claimed in claim 4 wherein the U-shaped member includes a plurality of punch outs proximate to the distal end thereof and the punch outs are configured to be welded to the joist moment connector assembly operably attached to the structural member.

6. The concrete fillable steel joist as claimed in claim 4 wherein the structural member is a concrete fillable steel joist and one of the hook member and rod member that is attached to the structural member is bolted through the concrete fillable steel joist.

7. The concrete fillable steel joist as claimed in claim 4 wherein the structural member is a steel I-beam and one of the hook member and rod member that is attached to the structural member is welded to the steel I-beam.

8. The concrete fillable steel joist as claimed in claim 1 wherein the joist ends are structural members.

9. The concrete fillable steel joist as claimed in claim 1 wherein the top chord further includes a pair of side tabs, wherein one side tab of the pair of side tabs extends outwardly from each of the elongate channels.

10. The concrete fillable steel joist as claimed in claim 9 wherein the side tabs include a plurality of spaced apart tab holes.

11. The concrete fillable steel joist as claimed in claim 1 wherein the U-shaped member includes a plurality of utility holes and wherein each utility hole has a rim that is operably attached to the spaced apart webs around the utility hole.

12. The concrete fillable steel joist as claimed in claim 1 wherein the U-shaped member further includes a pair of bottom chord tabs extending outwardly from the bottom chord on either side of the spaced apart webs.

13. A concrete fillable steel joist comprising:

a generally U-shaped member having spaced apart webs and a bottom chord;

a top chord operably attached to the U-shaped member, the top chord having a plurality of spaced apart top chord holes and having two elongate channels formed therein for receiving the spaced apart webs of the U-shaped member;

a pair of end plates operably attached at opposed ends of the U-shaped member; and whereby the U-shaped member, the top chord, and the pair of end plates define a volume that is fillable with concrete.

14. The concrete fillable steel joist as claimed in claim 13 further including a pair of joist support struts attached to opposed ends of the top chord and extending outwardly from the U-shaped member.

15. The concrete fillable steel joist as claimed in claim 14 further including a pair of joist shoes attached to each of the joist support struts at a distal end thereof.

16. The concrete fillable steel joist as claimed in claim 15 further including a pair of joist diagonal members on either side of the U-shaped member, the pair of joist diagonal members being operably attached to the U-shaped member and the pair of joist support struts and wherein the pair of the joist diagonal members are operably attached at the opposed ends of the U-shaped member.

17. The concrete fillable steel joist as claimed in claim 16 wherein each of the end plates of the pair of end plates have a generally vertical portion and an angled portion and the angled portion is generally in registration with the pair of joist diagonal members.

18. The concrete fillable steel joist as claimed in claim 14 wherein each of the joist support struts of the pair of joist support struts has a plurality of spaced apart strut holes.

19. A concrete fillable steel joist system comprising:

a plurality of spaced apart concrete fillable steel joists wherein each concrete fillable steel joist includes:

a generally U-shaped member having spaced apart webs and a bottom chord;

a top chord operably attached to the U-shaped member, the top chord having a plurality of spaced apart top chord holes and having two elongate channels formed therein for receiving the spaced apart webs of the U-shaped member; and whereby the U-shaped member and the top chord define a volume that is fillable with concrete when opposed ends of the U-shaped member have joist ends operably attached thereto;

metal decking operably attached between the spaced apart concrete fillable steel joists; and whereby the concrete fillable steel joist and the metal decking are configured to receive concrete.

20. The concrete fillable steel joist system as claimed in claim 19 wherein the plurality of spaced apart concrete fillable steel joists include a plurality of spaced apart concrete fillable steel joists further including a pair of end plates operably attached at the opposed ends of the U-shaped member and the pair of end plates are the U-shaped member joist ends;

and a plurality of spaced apart concrete fillable steel joists that are perpendicular thereto and wherein the U-shaped member joist ends are structural members.

21. The concrete fillable steel joist system as claimed in claim 19 wherein the metal decking includes a first deck portion and a second deck portion operably connected to each other.

22. The concrete fillable steel joist system as claimed in claim 21 wherein the first deck portion and the second deck portion have an overlapping joint.

23. The concrete fillable steel joist system as claimed in claim 22 further including bridging members extending between and operably attached to the metal decking and the U-shaped members of the concrete fillable steel joists.

24. The concrete fillable steel joist system as claimed in claim 23 wherein the bridging members extend between the bottom chords of the U-shaped members to the overlapping joint.

25. The concrete fillable steel joist system as claimed in claim 19 wherein the metal decking includes a plurality of spaced apart elongate bottom flanges, a plurality of spaced apart elongate top flanges, a plurality of elongate webs extending outwardly and downwardly from the top flanges to the bottom flanges and a pair of elongate re-entrant lips extending outwardly from each side of and generally in the same plane as the top flanges.

26. The concrete fillable steel joist system as claimed in claim 25 wherein the width of each of the plurality of top flanges and the pair of elongate re-entrant lips is less than the width of each of the plurality of bottom flanges.

27. The concrete fillable steel joist system as claimed in claim 25 further including bridging members operably connected between adjacent spaced apart U-shaped members of the concrete fillable steel joists.

28. The concrete fillable steel joist system as claimed in claim 19 wherein the top chord includes a pair of side tabs and a plurality of tab holes formed therein and the metal decking includes a plurality of decking tabs extendable downwardly therefrom and the tab holes are configured to receive the decking tabs.

29. The concrete fillable steel joist system as claimed in claim 28 wherein each decking tab includes a central portion and a pair of side wings and the side wings are bendable outwardly from the central portion.

* * * * *